US012390067B2

(12) United States Patent
Conrad

(10) Patent No.: US 12,390,067 B2
(45) Date of Patent: Aug. 19, 2025

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 0 days.

(21) Appl. No.: 17/988,866

(22) Filed: Nov. 17, 2022

(65) Prior Publication Data

US 2023/0143305 A1 May 11, 2023

Related U.S. Application Data

(63) Continuation of application No. 16/818,438, filed on Mar. 13, 2020, now Pat. No. 11,529,033.

(60) Provisional application No. 62/825,148, filed on Mar. 28, 2019, provisional application No. 62/818,856, filed on Mar. 15, 2019.

(51) Int. Cl.

| | |
|---|---|
| ***A47L 9/14*** | (2006.01) |
| ***A47L 5/24*** | (2006.01) |
| ***A47L 9/12*** | (2006.01) |
| ***A47L 9/16*** | (2006.01) |
| ***A47L 9/20*** | (2006.01) |

(52) U.S. Cl.

CPC ..... *A47L 9/149* (2013.01); *A47L 5/24* (2013.01); *A47L 9/12* (2013.01); *A47L 9/1608* (2013.01); *A47L 9/20* (2013.01)

(58) Field of Classification Search

None

See application file for complete search history.

(56) References Cited

U.S. PATENT DOCUMENTS

| | | | |
|---|---|---|---|
| 394,240 | A | 12/1888 | Allington |
| 1,779,023 | A | 10/1930 | Waters |
| 2,119,478 | A | 5/1938 | Whiton, Jr. |
| 2,192,357 | A | 3/1940 | Leathers |
| 2,461,677 | A | 2/1949 | Burdock et al. |
| 2,643,737 | A | 6/1953 | Bowers et al. |
| 2,734,630 | A | 2/1956 | Van Der Wal |
| 2,754,968 | A | 7/1956 | Vegter et al. |

(Continued)

FOREIGN PATENT DOCUMENTS

| | | | |
|---|---|---|---|
| CN | 108903789 | A | 11/2018 |
| DE | 202018102656 | U1 | 6/2018 |

(Continued)

OTHER PUBLICATIONS

English machine translation of JP2003339595A, published on Dec. 2, 2003.

(Continued)

*Primary Examiner* — Edward F Landrum
*Assistant Examiner* — Dana Lee Poon
(74) *Attorney, Agent, or Firm* — Philip C. Mendes da Costa; SMART & BIGGAR LP

(57) ABSTRACT

A surface cleaning apparatus has a housing defining at least part of a cyclone chamber and a pre-motor filter chamber. In one embodiment, the housing is pivotally mounted to the main body of a hand vacuum cleaner. The housing is moveable between an in use position and an emptying position, in which the cyclone chamber and the pre-motor filter are concurrently openable.

20 Claims, 18 Drawing Sheets

(56) References Cited

U.S. PATENT DOCUMENTS 2,840,240 A 6/1958 Snyder
2,867,290 A 1/1959 Mcgrane
3,349,548 A 10/1967 Boyen
3,636,682 A 1/1972 Rush
3,933,450 A 1/1976 Percevaut
3,990,870 A 11/1976 Miczek
4,203,961 A 5/1980 Cowley
4,276,262 A 6/1981 Cowley
4,336,228 A 6/1982 Cowley
4,394,143 A 7/1983 O'Dell
4,513,470 A 4/1985 Toya
4,713,096 A 12/1987 Kajihara
4,734,017 A 3/1988 Levin
4,821,366 A 4/1989 Levine
4,956,892 A 9/1990 Fawkes
5,060,341 A * 10/1991 Nelle ..... A47L 5/24 15/314
5,135,552 A 8/1992 Weistra
5,221,299 A 6/1993 Boring
5,961,701 A 10/1999 Hlynsky
5,966,774 A 10/1999 Bone et al.
6,156,106 A 12/2000 Kamata
6,171,356 B1 1/2001 Twerdun
6,195,835 B1 3/2001 Song et al.
6,251,296 B1 6/2001 Conrad et al.
6,406,505 B1 6/2002 Oh et al.
6,432,154 B2 8/2002 Oh et al.
6,493,903 B1 * 12/2002 Super ..... A47L 9/30 15/344
6,599,348 B2 7/2003 Chosnek et al.
6,625,845 B2 9/2003 Matsumoto et al.
6,758,874 B1 7/2004 Hunter
6,782,583 B2 8/2004 Oh
6,810,557 B2 11/2004 Hansen et al.
6,811,584 B2 11/2004 Oh
6,837,912 B1 1/2005 Heumann
6,928,692 B2 8/2005 Oh et al.
6,979,358 B2 12/2005 Ekker et al.
7,022,154 B2 4/2006 Oh
7,152,277 B2 12/2006 Jung et al.
7,293,657 B1 11/2007 Kelton et al.
7,398,578 B2 7/2008 Lee
7,419,520 B2 9/2008 Lee et al.
7,494,520 B2 2/2009 Nam et al.
7,662,201 B2 2/2010 Lee
7,803,207 B2 9/2010 Conrad
7,867,310 B2 1/2011 Baten
7,882,593 B2 2/2011 Beskow et al.
7,922,794 B2 4/2011 Morphey
7,958,597 B2 6/2011 Frantzen et al.
8,060,979 B2 11/2011 Park et al.
8,069,529 B2 12/2011 Groff et al.
8,152,877 B2 4/2012 Greene
8,156,609 B2 4/2012 Milne et al.
8,236,077 B2 8/2012 Gomiciaga-Pereda et al.
8,424,154 B2 4/2013 Beskow et al.
8,549,704 B2 10/2013 Milligan et al.
8,567,008 B2 10/2013 Conrad
8,607,406 B2 12/2013 Miefalk et al.
8,607,407 B2 12/2013 Conrad
8,640,304 B2 2/2014 Conrad
8,657,910 B2 2/2014 Park et al.
8,764,886 B2 7/2014 Halpap et al.
8,769,764 B2 7/2014 Crouch et al.
9,009,912 B2 4/2015 Conrad
9,027,198 B2 5/2015 Conrad
9,204,773 B2 12/2015 Conrad
9,521,936 B2 12/2016 Holz
9,808,134 B2 11/2017 Hyun et al.
9,980,620 B2 5/2018 Sjberg
10,258,208 B2 4/2019 Conrad
10,327,612 B2 6/2019 Conrad
10,561,286 B2 2/2020 Conrad
10,729,296 B2 8/2020 Kah, Jr.
11,445,873 B2 9/2022 Conrad et al.
11,445,874 B2 9/2022 Conrad et al.
2001/0008035 A1 7/2001 Kim
2001/0025395 A1 10/2001 Matsumoto et al.
2001/0042283 A1 11/2001 Oh et al.
2002/0011053 A1 1/2002 Oh
2002/0112998 A1 8/2002 Bosman
2003/0037406 A1 2/2003 Wright et al.
2003/0106182 A1 6/2003 Lee
2003/0159235 A1 8/2003 Oh
2003/0208878 A1 11/2003 Alford et al.
2003/0208879 A1 11/2003 Oh et al.
2004/0128790 A1 7/2004 Mudd
2004/0163206 A1 8/2004 Oh
2004/0187253 A1 9/2004 Jin et al.
2005/0115409 A1 6/2005 Conrad
2005/0132528 A1 6/2005 Yau
2005/0172586 A1 8/2005 Oh et al.
2005/0198766 A1 9/2005 Nam et al.
2006/0026791 A1 2/2006 Fischer et al.
2006/0042039 A1 3/2006 Mcdowell et al.
2006/0042202 A1 3/2006 Lee et al.
2006/0075727 A1 4/2006 Kim et al.
2006/0090290 A1 5/2006 Lau
2006/0101611 A1 5/2006 Oh et al.
2006/0162117 A1 7/2006 Thomas et al.
2006/0230715 A1 10/2006 Oh et al.
2006/0283158 A1 12/2006 Kennedy
2007/0079587 A1 4/2007 Kim
2007/0084160 A1 4/2007 Kim
2007/0101536 A1 5/2007 Nielsen
2008/0047091 A1 2/2008 Nguyen
2008/0172992 A1 7/2008 Conrad
2008/0209669 A1 9/2008 Kah
2008/0244860 A1 10/2008 Gammack et al.
2008/0256744 A1 10/2008 Rowntreer et al.
2008/0264016 A1 10/2008 Oh et al.
2008/0295466 A1 12/2008 Cha et al.
2009/0049639 A1 2/2009 Gordon
2009/0165431 A1 7/2009 Oh
2009/0276974 A1 11/2009 Khalil et al.
2011/0000047 A1 1/2011 Ji et al.
2011/0289720 A1 12/2011 Han et al.
2012/0036675 A1 2/2012 Conrad
2012/0151888 A1 6/2012 Yoshimura et al.
2012/0222252 A1 9/2012 Conrad
2012/0311979 A1 12/2012 Conrad
2013/0269147 A1 10/2013 Conrad
2014/0020205 A1 1/2014 Makarov
2014/0216333 A1 8/2014 Hoversten et al.
2014/0366310 A1 12/2014 Conrad
2014/0366311 A1 12/2014 Han et al.
2016/0000284 A1 1/2016 Gui et al.
2016/0100728 A1 4/2016 Lavoie
2016/0106285 A1 4/2016 Jenson
2016/0158681 A1 6/2016 Kim et al.
2016/0183750 A1 6/2016 Fan et al.
2016/0206167 A1 7/2016 Kim et al.
2017/0105591 A1 4/2017 Bernhard-Tanis
2017/0290479 A1 10/2017 Conrad
2017/0303758 A1 10/2017 Conrad et al.
2018/0055310 A1 3/2018 Conrad et al.
2018/0055318 A1 3/2018 Gottschall et al.
2018/0110383 A1 4/2018 Jenson
2018/0132685 A1 5/2018 Muir et al.
2018/0238620 A1 8/2018 Baxter et al.
2018/0303301 A1 10/2018 Conrad et al.
2018/0353030 A1 12/2018 Wall et al.
2018/0353035 A1 12/2018 Kwak et al.
2018/0368639 A1 12/2018 Peters et al.
2018/0368640 A1 12/2018 Griffiths et al.
2019/0082925 A1 3/2019 Conrad et al.
2019/0090701 A1 * 3/2019 Tonderys ..... A47L 9/106
2019/0090710 A1 3/2019 Marcus et al.
2019/0133389 A1 5/2019 Nam et al.
2019/0200827 A1 7/2019 Crouch et al.
2019/0282048 A1 9/2019 Conrad et al.
2019/0282052 A1 * 9/2019 Conrad ..... A47L 9/1666
2019/0290084 A1 * 9/2019 Conrad ..... A47L 9/1658
2019/0328188 A1 * 10/2019 Conrad ..... A47L 9/1608

(56) References Cited

U.S. PATENT DOCUMENTS

| | | | | |
|---|---|---|---|---|
| 2020/0037838 | A1 | 2/2020 | Paulla et al. | |
| 2020/0055216 | A1 | 2/2020 | Schipper et al. | |
| 2020/0100633 | A1 | 4/2020 | Han et al. | |
| 2020/0163507 | A1 | 5/2020 | Percy-Raine et al. | |
| 2020/0196814 | A1 | 6/2020 | Grebing | |
| 2020/0230621 | A1 | 7/2020 | Conrad | |
| 2020/0230623 | A1* | 7/2020 | Conrad | B04C 5/103 |
| 2020/0383538 | A1 | 12/2020 | Lee et al. | |
| 2020/0383544 | A1* | 12/2020 | Conrad | A47L 9/16 |
| 2022/0047133 | A1 | 2/2022 | Sergyeyenko et al. | |

FOREIGN PATENT DOCUMENTS

| | | | |
|---|---|---|---|
| EP | 2389849 | A2 | 11/2011 |
| GB | 2370006 | B | 10/2003 |
| GB | 2487387 | A | 7/2012 |
| JP | 2002315701 | A | 10/2002 |
| JP | 2003339595 | A | 12/2003 |
| JP | 3813882 | B2 | 8/2006 |
| JP | 4202903 | B2 | 12/2008 |
| JP | 2013220169 | A | 10/2013 |
| WO | 2017046560 | A1 | 3/2017 |
| WO | 2017144918 | A1 | 8/2017 |

OTHER PUBLICATIONS

English machine translation of JP2002315701, published on Oct. 29, 2002.

English machine translation of DE202018102656U1, published on Jun. 28, 2018.

English machine translation of JP2013220169A1, published on Oct. 28, 2013.

English machine translation of CN108903789A, published on Nov. 30, 2018.

English machine translation of JP4202903B2, published on Dec. 24, 2018.

English machine translation of JP3813882B2, published on Aug. 23, 2006.

* cited by examiner

SURFACE CLEANING APPARATUS

CROSS-REFERENCE TO RELATED APPLICATION

This application is a continuation of U.S. patent application Ser. No. 16/818,438, filed on Mar. 13, 2020, which itself claims the benefit of priority from U.S. Provisional Patent Application No. 62/825,148, filed on Mar. 28, 2019 and also claims priority from U.S. Patent Application No. 62/818,856, filed on Mar. 15, 2019, the content of each of which is incorporated herein by reference in its entirety.

FIELD

This disclosure relates generally to an emptying mechanism for a surface cleaning apparatus and a surface cleaning apparatus having same. The surface cleaning apparatus is optionally a hand vacuum cleaner.

INTRODUCTION

The following is not an admission that anything discussed below is part of the prior art or part of the common general knowledge of a person skilled in the art.

Various types of surface cleaning apparatus are known. Such surface cleaning apparatus include vacuum cleaners, including upright vacuum cleaners, hand carryable vacuum cleaners, canister-type vacuum cleaners, extractors and wet/dry type vacuum cleaners (e.g. Shop-Vac™). Some vacuum cleaners include a cyclonic separator (also referred to as a cyclone bin assembly) having a cyclone chamber and a dirt collection chamber. A suction motor is used to draw air through the surface cleaning apparatus. A filter, such as a pre-motor filter, may be provided in the airflow path through the surface cleaning apparatus.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

In one aspect, a surface cleaning apparatus, which may be a hand carryable surface cleaning apparatus, is provided which has a housing, which defines at least part of an air treatment chamber and at least part of a filter chamber. The housing is operable (e.g., pivotally moveable) between an in use position and an emptying position. In the emptying position, each of the air treatment chamber and the filter chamber are opened. An advantage of such a design is that a single movement may permit dirt collected in the air treatment chamber to be emptied and the filter to be removed. A further advantage is that the housing may be emptied without removing any component from the surface cleaning apparatus.

In accordance with this aspect, there is provided a hand vacuum cleaner having a front end and a rear end and a longitudinal axis extending between the front and rear ends, the hand vacuum cleaner having:

(a) a main body;

(b) an air flow passage extending from a dirty air inlet to a clean air outlet wherein an air treatment chamber, a filter in a filter chamber and a suction motor are provided in the air flow passage;

(c) a housing rotatably mounted to the main body about a rotational axis, the housing including at least a portion of the air treatment chamber and at least a portion of the filter chamber, the housing moveable between an in use position in which each of the air treatment chamber and the filter chamber are closed and an emptying position in which each of the air treatment chamber and the filter chamber are open, a first end of the housing having an open end of the air treatment chamber when the housing is in the emptying position and a second end of the housing longitudinally spaced from the first end having an open end of the filter chamber when the housing is in the emptying position, wherein when the housing is in emptying position, the first end is located on one side of the rotational axis and the second end is located on an opposite side of the rotational axis.

In some embodiments, the housing may be rotatably mounted to the main body at a location between the first and second ends.

In some embodiments, the hand vacuum cleaner may have an upper end and a lower end and, when the housing is in emptying position, the first end may face downwardly and the second end may face upwardly.

In some embodiments, the filter may be located in the portion of the filter chamber provided in the housing.

In some embodiments, the open end of the air treatment chamber may extend in a first plane, the longitudinal axis may intersect the first plane and an included angle between the longitudinal axis and the first plane may be acute, and the open end of the filter chamber may extend in a second plane that is generally parallel to the first plane.

In some embodiments, the air treatment chamber may be positioned in the air flow passage downstream from the dirty air inlet, the filter may be positioned in the air flow passage downstream from the air treatment chamber and the suction motor may be positioned in the air flow passage downstream from the filter wherein the air treatment chamber, the filter and the suction motor may be arranged linearly when the housing is in the in use position.

In another aspect, when the housing is in emptying position, the first end may be located on one side of the longitudinal axis and the second end may be located on an opposite side of the longitudinal axis.

In accordance with this aspect, there is also provided a hand vacuum cleaner having a front end and a rear end and a longitudinal axis extending between the front and rear ends, the hand vacuum cleaner having:

(a) a main body;

(b) an air flow passage extending from a dirty air inlet to a clean air outlet wherein an air treatment chamber, a filter in a filter chamber and a suction motor are provided in the air flow passage;

(c) a housing rotatably mounted to the main body, the housing including at least a portion of the air treatment chamber and at least a portion of the filter chamber, the housing moveable between an in use position in which each of the air treatment chamber and the filter chamber are closed and an emptying position in which the each of the air treatment chamber and the filter chamber are open, a first end of the housing having an open end of the air treatment chamber when the housing is in the emptying position and a second end of the housing longitudinally spaced from the first end having an open end of the filter chamber when the housing is in the emptying position, wherein when the housing is in emptying position, the first end is located on one side of the longitudinal axis and the second end is located on an opposite side of the longitudinal axis.

In some embodiments, the housing may be rotatably mounted to the main body at a location between the first and second ends.

In some embodiments, the hand vacuum cleaner may have an upper end and a lower end and, when the housing is in emptying position, the first end may face downwardly and the second end may face upwardly.

In some embodiments, the filter may be located in the portion of the filter chamber provided in the housing.

In some embodiments, the open end of the air treatment chamber may extend in a first plane, the longitudinal axis may intersect the first plane and an included angle between the longitudinal axis and the first plane may be acute, and the open end of the filter chamber may extend in a second plane that is parallel to the first plane.

In some embodiments, the air treatment chamber may be positioned in the air flow passage downstream from the dirty air inlet, the filter may be positioned in the air flow passage downstream from the air treatment chamber and the suction motor may be positioned in the air flow passage downstream from the filter wherein the air treatment chamber, the filter and the suction motor may be arranged linearly when the housing is in the in use position.

In another aspect, as the housing is moved from the in use position to the emptying position, the first end is moved in a first direction and the second end is moved in a direction opposite to the first direction.

In accordance with this aspect, there is provided a hand vacuum cleaner having a front end and a rear end and a longitudinal axis extending between the front and rear ends, the hand vacuum cleaner having:

(a) a main body;

(b) an air flow passage extending from a dirty air inlet to a clean air outlet wherein an air treatment chamber, a filter in a filter chamber and a suction motor are provided in the air flow passage;

(c) a housing moveably mounted to the main body, the housing including at least a portion of the air treatment chamber and at least a portion of the filter chamber, the housing moveable between an in use position in which each of the air treatment chamber and the filter chamber are closed and an emptying position in which the each of the air treatment chamber and the filter chamber are open, a first end of the housing having an open end of the air treatment chamber when the housing is in the emptying position and a second end of the housing longitudinally spaced from the first end having an open end of the filter chamber when the housing is in the emptying position, wherein as the housing is moved from the in use position to the emptying position, the first end is moved in a first direction and the second end is moved in a direction opposite to the first direction.

In some embodiments, the housing may be moveably mounted to the main body at a location between the first and second ends.

In some embodiments, the hand vacuum cleaner may have an upper end and a lower end and, when the housing is in emptying position, the first end may face downwardly and the second end may face upwardly.

In some embodiments, the filter may be located in the portion of the filter chamber provided in the housing.

In some embodiments, the open end of the air treatment chamber may extend in a first plane, the longitudinal axis may intersect the first plane and an included angle between the longitudinal axis and the first plane may be acute, and the open end of the filter chamber may extend in a second plane that is parallel to the first plane.

In some embodiments, the air treatment chamber may be positioned in the air flow passage downstream from the dirty air inlet, the filter may be positioned in the air flow passage downstream from the air treatment chamber and the suction motor may be positioned in the air flow passage downstream from the filter wherein the air treatment chamber, the filter and the suction motor may be arranged linearly when the housing is in the in use position.

In another aspect, the sidewall of the surface cleaning apparatus includes a longitudinally extending portion, which may be a lower portion, that moves between a closed position and an open emptying position.

In accordance with this aspect, there is provided a hand vacuum cleaner having a front end, a rear end, an upper end, a lower end and a longitudinal axis extending between the front and rear ends, the hand vacuum cleaner having:

(a) a main body;

(b) an air flow passage extending from a dirty air inlet to a clean air outlet wherein an air treatment chamber, a pre-motor filter in a pre-motor filter chamber and a suction motor are provided in the air flow passage; and, (c) the air treatment chamber having a front end, a rear end and a sidewall extending between the front and rear ends of the air treatment chamber, the sidewall of the air treatment chamber including an upper longitudinally extending portion and a lower longitudinally extending portion, wherein the upper and lower longitudinally extending portions abut at a juncture that extends longitudinally and the upper and lower longitudinally extending portions are moveably between a closed position and an open emptying position.

In some embodiments, the juncture may be located in a longitudinally extending plane.

In some embodiments, the longitudinally extending plane may extend generally horizontally when an upper portion of the hand vacuum cleaner is positioned above a lower portion of the hand vacuum cleaner.

In some embodiments, the lower longitudinally extending portion may rotate downwardly.

In some embodiments, a forward portion of the lower longitudinally extending portion may be pivotally mounted to a remainder of the hand vacuum cleaner.

In some embodiments, a rearward portion of the lower longitudinally extending portion may be pivotally mounted to a remainder of the hand vacuum cleaner.

In some embodiments, a screen may be positioned in the air treatment chamber wherein the screen may be moveable to a cleaning position.

In some embodiments, when the lower longitudinally extending portion is in the open emptying position, the screen may be moveable to the cleaning position.

In some embodiments, the screen may be moveable to the cleaning position concurrently with the lower longitudinally extending portion moving to the open emptying position.

In some embodiments, the screen may be rotatably mounted at a rear end of the air treatment chamber.

In some embodiments, the lower longitudinally extending portion may rotate downwardly and the screen may rotate the same amount as the lower longitudinally extending portion.

In some embodiments, the lower longitudinally extending portion may rotate downwardly and the screen may rotate a lesser amount than the lower longitudinally extending portion.

In some embodiments, the air treatment chamber may have a cyclone chamber.

In some embodiments, the pre-motor filter may be removable through the air treatment chamber when the lower longitudinally extending portion is in the open emptying position.

In some embodiments, the pre-motor filter may be translatable forwardly once the lower longitudinally extending portion is in the open emptying position.

In some embodiments, the pre-motor filter may be removable when the lower longitudinally extending portion is in the closed position.

In some embodiments, the pre-motor filter may be removable through an opening provided in a longitudinally extending sidewall of the main body.

In some embodiments, the pre-motor filter may be removable in a direction transverse to the longitudinal axis.

In some embodiments, the pre-motor filter may be provided in a pre-motor filter housing and a portion of the housing may form a portion of the sidewall of the main body.

In some embodiments, the air treatment chamber may be pivotally mounted to the main body and the pre-motor filter chamber may be opened when the air treatment chamber is pivoted to an open position.

In another aspect, the filter chamber may be opened by rotating portion of the hand vacuum cleaner relative to another portion of the hand vacuum cleaner so as to open the filter chamber and, optionally, a rear end of the filter chamber. An advantage such a design is that the filter may be removed without opening the air treatment chamber.

In accordance with this aspect, there is provided a hand vacuum cleaner having a front end, a rear end, an upper end, a lower end and a longitudinal axis extending between the front and rear ends, the hand vacuum cleaner having:

(a) a main body;

(b) an air flow passage extending from a dirty air inlet to a clean air outlet wherein an air treatment chamber, a pre-motor filter in a pre-motor filter chamber and a suction motor are provided in the air flow passage; and, wherein the air treatment chamber may be provided in a housing that may be rotatably mounted to the main body and moveable between a closed in use position and an open position and the pre-motor filter chamber may be opened when the housing may be rotated to the open position.

In some embodiments, the housing may be pivotally mounted to the main body.

In some embodiments, a rear end of the pre-motor filter chamber may be rotatably mounted to the main body In some embodiments, a rear end of the housing may be rotatably mounted to the main body.

In some embodiments, a rear end of the pre-motor filter chamber may be opened when the housing is rotated to the open position.

In some embodiments, a rear end of the pre-motor filter chamber may be opened and may face upwardly when the housing is rotated to the open position and the upper end of the longitudinal axis extends horizontally.

In some embodiments, the air treatment chamber may be provided in the housing.

In some embodiments, the air treatment chamber may be provided in the housing forward of the pre-motor filter.

In some embodiments, the air treatment chamber may have a cyclone chamber.

In some embodiments, the air treatment chamber may be openable independently of the pre-motor filter chamber.

In some embodiments, the air treatment chamber may be openable after the pre-motor filter chamber has been opened.

In some embodiments, the surface cleaning apparatus may have a handle wherein the handle may have a hand grip portion that may extend generally axially.

In some embodiments, a rear end of the pre-motor filter chamber may be opened and may face upwardly when the housing is rotated to the open position and the upper end of the longitudinal axis extends horizontally.

In some embodiments, the pre-motor filter may be a porous filter media.

In some embodiments, the porous filter media may include a foam filter.

In another aspect, a housing of an air treatment chamber, which may be a cyclone chamber, includes a forward portion and a rearward portion wherein at least one of the forward and rearward portions is moveable between a closed position and an open emptying position. In the closed position, the forward and rearward portions meet along a line that is diagonal to the longitudinal axis of the chamber.

In accordance with this aspect, there is provided a hand vacuum cleaner having a front end, a rear end, an upper end, a lower end and a longitudinal axis extending between the front and rear ends, the hand vacuum cleaner having:

(a) a main body;

(b) an air flow passage extending from a dirty air inlet to a clean air outlet wherein an air treatment chamber and a suction motor are provided in the air flow passage; and, (c) a housing including the air treatment chamber having a front end, a rear end and a sidewall extending between the front and rear ends of the air treatment chamber, the housing including a forward portion having a rearward edge and a rearward portion having a forward edge, wherein the forward edge and rearward edge abut at a juncture that extends at an angle between 5 and 85° to the longitudinal axis and the forward and rearward portions are moveably between a closed position and an open emptying position in which the air treatment chamber may be opened.

In some embodiments, the forward and rearward portions may be rotatably mounted with respect to each other.

In some embodiments, the forward portion may include the air inlet.

In some embodiments, the forward portion may be pivotally mounted to a forward end of the rearward portion.

In some embodiments, the forward portion may be rotated forwardly from the closed position to the open position.

In some embodiments, the air treatment chamber may include a cyclone chamber and a dirt collection chamber may be provided exterior to the cyclone chamber and both the cyclone chamber and the dirt collection chamber may be opened when the forward and rearward portions are in the open emptying position.

In some embodiments, the surface cleaning apparatus may have an ejector provided in the cyclone chamber wherein the ejector may be translatable forwardly.

In some embodiments, the ejector may be translatable forwardly subsequent to the cyclone chamber opening.

In some embodiments, the ejector may include an annular member moveable between an in use position in which the ejector may be positioned at a rear end of the cyclone chamber and an emptying position in which the ejector has been translated forwardly.

In some embodiments, the rearward edge of the forward portion may have a front most portion and a rearmost portion and the forward edge of the rearward portion may have a front most portion and a rearmost portion and, in the closed position, the rearmost portion of the rearward edge may be rearward of the front most portion of the forward edge and the front most portion of the forward edge may be forward of the rearmost portion of the rearward edge.

In some embodiments, the rearmost portion of the rearward edge may be below the front most portion of the rearward edge when the longitudinal axis is horizontal and the upper end is above the lower end.

In some embodiments, the juncture may extend upwardly and forwardly when the longitudinal axis is horizontal and the upper end is above the lower end.

In some embodiments, the forward portion may be rotated rearwardly from the closed position to the open position.

In some embodiments, the rearmost portion of the rearward edge may be above the front most portion of the rearward edge when the longitudinal axis is horizontal and the upper end is above the lower end.

In some embodiments, the juncture extends upwardly and rearwardly when the longitudinal axis is horizontal and the upper end is above the lower end.

In some embodiments, the rearward portion may be pivotally mounted to the main body.

In some embodiments, each of the forward portion and the rearward portion may be rotatably mounted to the main body.

In some embodiments, the forward portion may be rotatably mounted to an upper end of the main body and the rearward portion may be rotatably mounted to a lower end of the main body.

In another aspect, a sidewall of a housing of the surface cleaning apparatus is rearwardly translatable.

In accordance with this aspect, there is provided a hand vacuum cleaner having a front end, a rear end, an upper end, a lower end and a longitudinal axis extending between the front and rear ends, the hand vacuum cleaner having:

(a) a main body;

(b) an air flow passage extending from a dirty air inlet to a clean air outlet wherein an air treatment chamber and a suction motor are provided in the air flow passage; and, (c) a housing including the air treatment chamber having a front end, a rear end and a sidewall extending between the front and rear ends of the air treatment chamber, wherein the front end may be rotatably mountable to the hand vacuum cleaner between an in use position and an open emptying position and the sidewall may be translatable rearwardly when the front end may be in the open emptying position.

In some embodiments, the front end may be rotated rearwardly from the closed position to the open position.

In some embodiments, the front end may include the dirty air inlet.

In some embodiments, the front end may include a cleaning tool electrical connector electrically engageable with a cleaning tool.

In some embodiments, the sidewall may include an electrical lead extending from a main body electrical contact to the cleaning tool electrical connector.

In some embodiments, the sidewall may be translatable between a forward position and a rearward emptying position and the electrical lead may be electrically connected to the main body electrical contact when the sidewall is in its forward position.

In some embodiments, the electrical lead may be disconnected from the main body electrical contact when the sidewall is in its rearward position.

These and other aspects and features of various embodiments will be described in greater detail below.

DRAWINGS

For a better understanding of the described embodiments and to show more clearly how they may be carried into effect, reference will now be made, by way of example, to the accompanying drawings in which.

DESCRIPTION OF VARIOUS EMBODIMENTS

Figure 1:
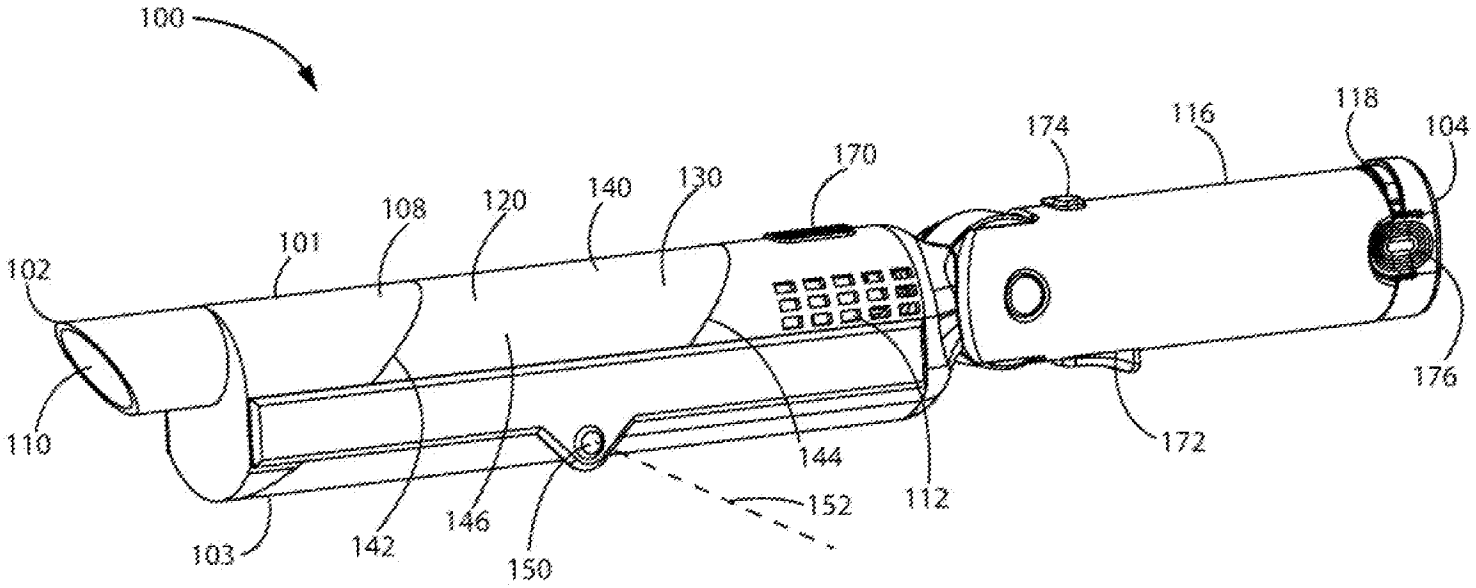
FIG. 1 is a perspective view of a surface cleaning apparatus in an in use position.

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", "joined", "affixed", or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly joined", "directly affixed", or "directly fastened" where the parts are connected in physical contact with each other. As used herein, two or more parts are said to be "rigidly coupled", "rigidly connected", "rigidly attached", "rigidly joined", "rigidly affixed", or "rigidly fastened" where the parts are coupled so as to move as one while maintaining a constant orientation relative to each other. None of the terms "coupled", "connected", "attached", "joined", "affixed", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. In addition, the description is not to be considered as limiting the scope of the example embodiments described herein.

General Description of a Vacuum Cleaner

FIGS. 1 to 8 show an exemplary embodiment of a surface cleaning apparatus 100 that may use one or more aspects of an emptying mechanism that are disclosed herein. The following is a general discussion of the surface cleaning apparatus 100, which provides a basis for understanding several of the features discussed herein. As discussed subsequently, each of the features may be used individually or in any particular combination or sub-combination in this or in other embodiments disclosed herein.

The surface cleaning apparatus 100 may be any type of surface cleaning apparatus including, for example, a hand vacuum cleaner (as shown), a stick vacuum cleaner, an upright vacuum cleaner, a canister vacuum cleaner, an extractor, or a wet/dry type vacuum cleaner. In the embodiment shown, the surface cleaning apparatus 100 is a hand vacuum cleaner. Optionally, the surface cleaning apparatus may use one or more cyclones and may therefore be a cyclonic surface cleaning apparatus.

As exemplified in FIG. 1, the surface cleaning apparatus 100 has a front end 102, a rear end 104, and a longitudinal axis 106 extending between the front and rear ends 102, 104. The surface cleaning apparatus 100 has an upper end 101 and a lower end 103. The surface cleaning apparatus 100 has a dirty air inlet 110, a clean air outlet 112, and an airflow passage extending therebetween. The airflow passage has a direction of flow from the dirty air inlet 110 to the clean air outlet 112. An air treatment chamber 120, a filter chamber 130, and a suction motor 114 are provided in the airflow passage.

The surface cleaning apparatus 100 has a main body 108, which includes a handle 116. Accordingly, in this embodiment, the main body 108 extends from the front end 102 to the rear end 104. A housing 140 is mounted to the main body 108. The housing 140 has a first end 142, a second end 144, and a sidewall 146 extending from the first end 142 to the second end 144. The second end 144 is longitudinally (rearwardly as exemplified) spaced from the first end 142. The housing 140 includes at least a portion of the air treatment chamber 120 and at least a portion of the filter chamber 130. It will be appreciated that a main body that receives a moveable housing 140 may be of various designs.

The air treatment chamber 120 has a first end 122 and a second end 124 with a sidewall 126 extending therebetween. The air treatment chamber has an upper end 121 and a lower end 123. In some embodiments, the air treatment chamber 120 may comprise a cyclone, a plurality of cyclones, or a plurality of cyclonic stages. As exemplified, the air treatment chamber comprises a single cyclone chamber. It will be appreciated that housing 140 may comprise only part of, essentially all, or all of the air treatment chamber. The remainder of the air treatment chamber may be part of the main body.

The air treatment chamber 120 may house a porous air treatment member 128, which is positioned in the airflow passage downstream of the dirty air inlet 110, for removing particulate matter from air flowing through the airflow passage. In some embodiments, the air treatment member 128 may be, for example, a screen or shroud as is known in the art.

The filter chamber 130 may be positioned downstream from the air treatment chamber and upstream of the suction motor. Accordingly, the filter chamber 130 may be a pre-motor filter chamber. The filter chamber 130 has a first end 132, a second end 134, and a sidewall 136 extending therebetween. The filter chamber 130 has an upper end 131 and a lower end 133. At least one filter 138 is located within the filter chamber 130. It will be appreciated that the filter 138 may be any filter known in the art. For example, the filter 138 may be physical filter media such as one or more of a foam filter, a felt filter, a HEPA filter or the like. It will be appreciated that housing 140 may comprise only part of, essentially all, or all of the filter chamber. The remainder of the filter chamber may be part of the main body. For example, when in the emptying position, the filter may remain in the main housing.

As exemplified, in use, air flows into the surface cleaning apparatus 100 through the dirty air inlet 110 into the air treatment chamber 120. The screen 128 separates particulate matter from the air in the air treatment chamber 120. The particulate matter settles in the air treatment chamber 120 and/or a dirt chamber exterior to the air treatment chamber 120. The air exits the air treatment chamber 120 and then travels through the filter chamber 130 whereupon the air passes through the filter 138. The air flows from the filter 138 to the suction motor 114 and then out the clean air outlet 112.

It will be appreciated that the various elements discussed herein are for reference for the discussion of the specific exemplified embodiments and that the elements such as the handle, the screen and filter, the suction motor and the like may be of various constructions known in the art. It will also be appreciated that some elements that are discussed are optional and need not be in any particular embodiment.

Description of a Moveable Housing with Openable Opposed Ends

In some cases, emptying a dirt container, such as an air treatment chamber in which dirt is accumulated, may be complicated and may run the risk of collected dirt not being received in the desired refuse receptacle. Further, a user may have to handle a part that is dirty or the user may have to handle a part that is near to the emptying end of a dirt container of a surface cleaning apparatus. For example, a user may have to remove a dirty filter or other components of the surface cleaning apparatus in order to empty the collected dust and particulate matter. Removing components increases the likelihood of spreading dust and particulate matter as well as dirtying the user's hands.

According to this aspect, housing 140 is moveably mounted to the main body. As the housing is moved from the in use position to the emptying position, the first end is moved in a first direction and the second end is moved in a direction opposite to the first direction. For example, the housing may be rotatably mounted to the main body. Such a structure may allow the surface cleaning apparatus to be emptied easily, without having to remove any additional components and without a user having to handle any portion of the surface cleaning apparatus proximate the open end of the dirt collection region of the surface cleaning apparatus. As exemplified in FIGS. 3 and 4, when in the emptying position, the housing 140 may provide access to both the air treatment chamber and the filter chamber.

FIGS. 1 to 8 exemplify an embodiment wherein all of the lower end of the air treatment chamber is part of housing 140 and accordingly housing 140 includes a substantial portion of the air treatment chamber. Similarly, all of the upper end of the filter chamber is part of housing 140 and accordingly housing 140 includes a substantial portion of the filter chamber. As exemplified, the front of the filter chamber abuts the rear of the air treatment chamber and two chambers may be separated by a single wall having the air treatment chamber air outlet therein. As exemplified, the housing 140 is pivotally mounted to the main body 108 about axis 152. Rotating the housing 140 about axis 152 allows the housing 140 to move between an in use position (see, e.g., FIG. 1) and an emptying position (see, e.g., FIG. 3A). When in the in use position, as exemplified in FIGS. 1 and 2, each of the air treatment chamber 120 and the filter chamber 130 are closed. As the air treatment chamber and the filter chamber are at opposite sides of the housing (and the open end of the air treatment chamber is on the opposite side of the rotational axis from the open end of the filter chamber), when in the emptying position, as exemplified in FIGS. 3 and 4 the first end 142 of the housing 140 provides access to the air treatment chamber 120 while the second end 144 of the housing 140 provides access to the filter chamber 130.

As exemplified in FIGS. 1 to 8, the housing 140 is pivotally mounted to the main body 108 by a pivot 150. The pivot 150 allows the housing 140 to rotate about the rotational axis 152. The housing 140 may be pivotally mounted to the main body at a location between the one of the first and second ends 142, 144, or at a location therebetween. As exemplified, the pivot 150 is located approximately at the midpoint of the housing 140 between the first end 142 and the second end 144. An advantage of such a placement is that, when the housing is in the emptying position, the open end of the filter chamber may be positioned on an opposite side of the longitudinal axis 106 from the open end of the air treatment chamber, and, optionally, radially outwardly of the outer surface of the surface cleaning apparatus. For example, referring to FIG. 5B, the first end 142 is located below the longitudinal axis 106 while the second end 144 is located above the longitudinal axis 106.

It will be appreciated that the length in the longitudinal direction of the air treatment chamber in housing 140 may be similar to the length in the longitudinal direction of the filter chamber in housing 140. Therefore, if the pivot 150 is located at a location approximately midway along the length in the longitudinal direction of the housing 140, then pivot 150 may be located at or proximate to the rear end of the air treatment chamber 120.

Figure 3A:
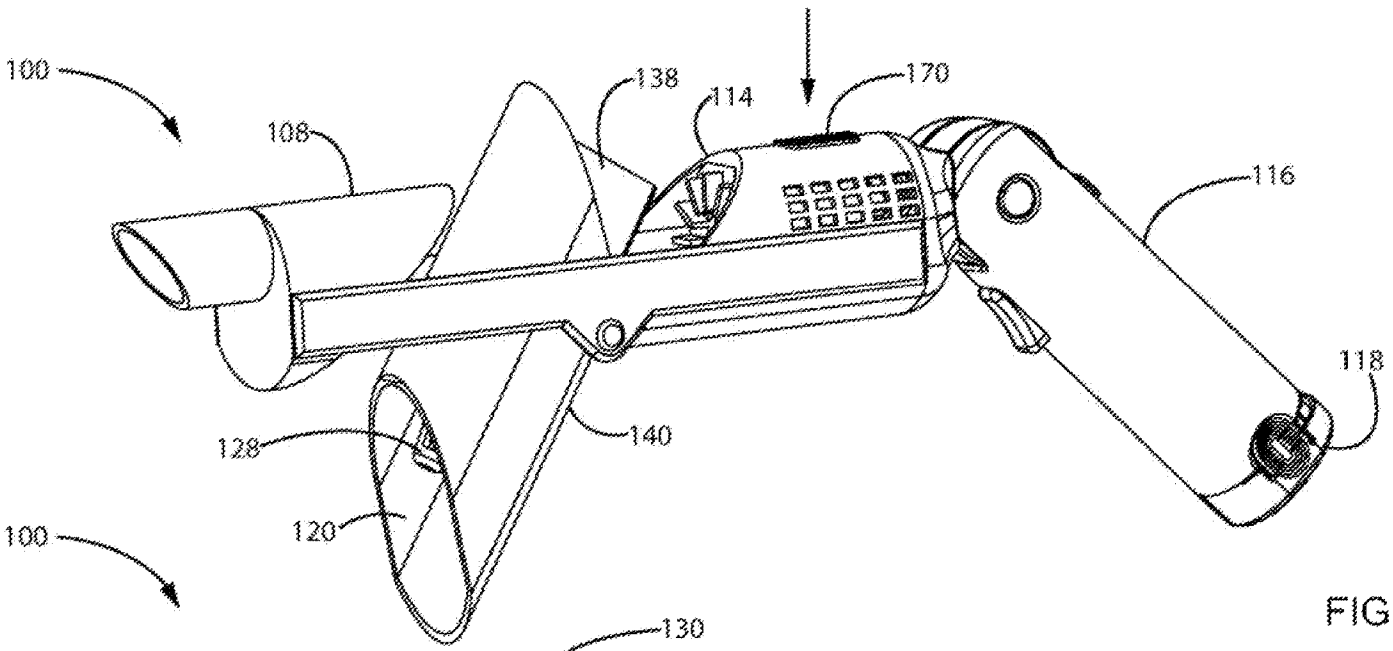
FIGS. 3A and 3B are perspective views of the surface cleaning apparatus of FIG. 1 in an emptying position.
Figure 3B:
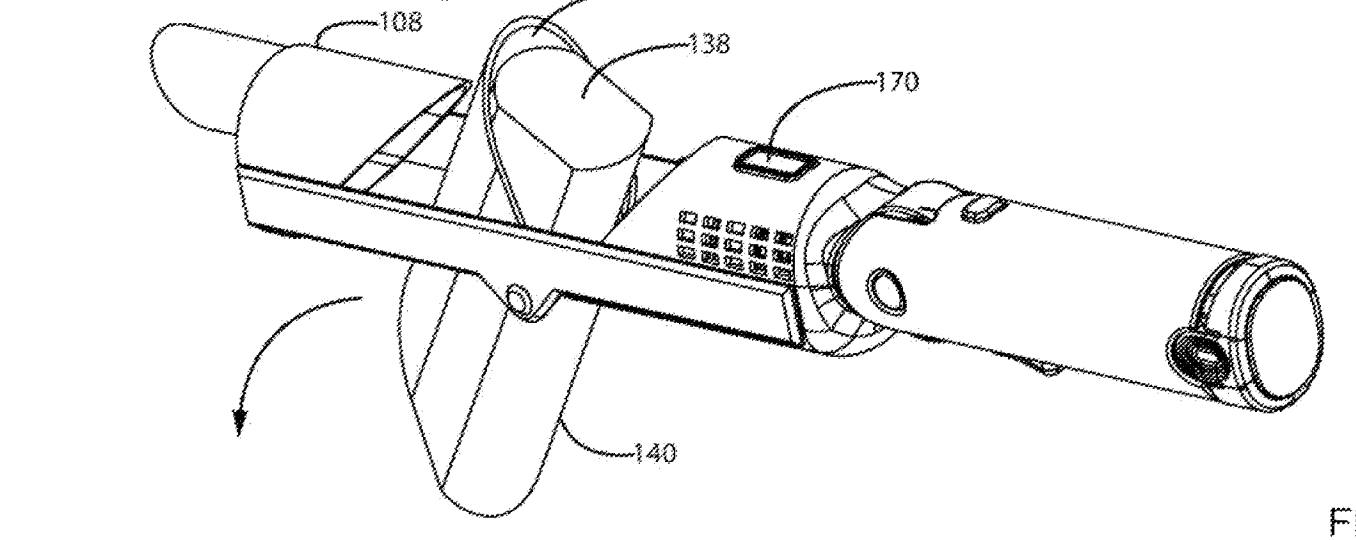
Figure 4A:
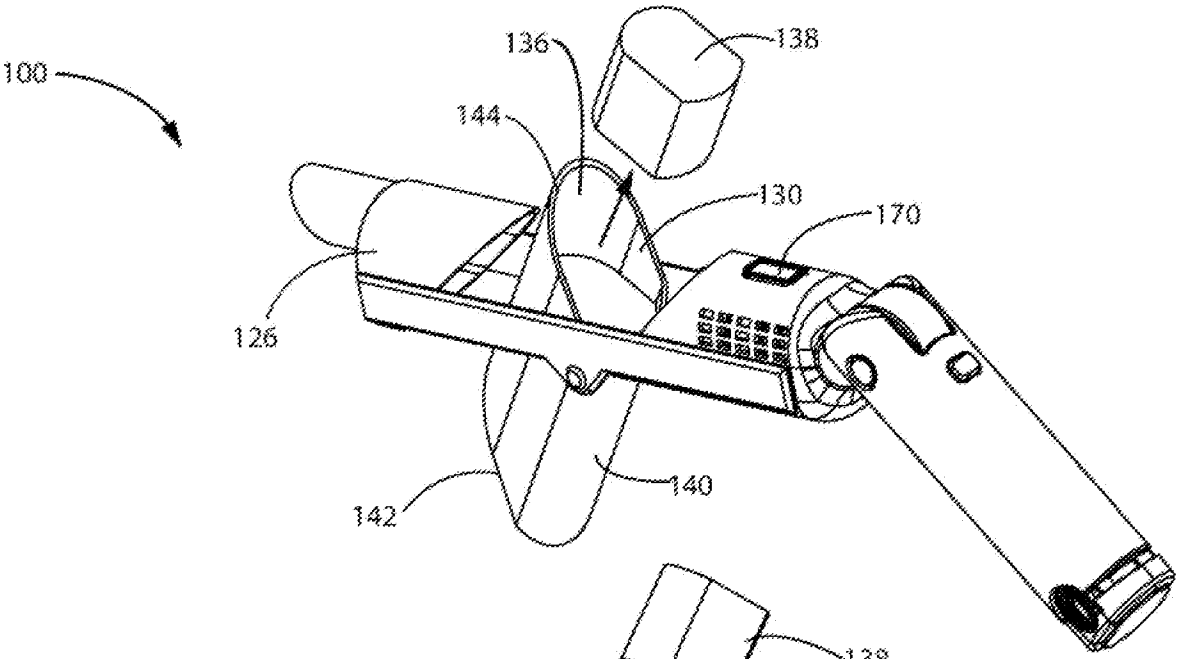
FIGS. 4A and 4B are perspective views of the surface cleaning apparatus of FIG. 1 in the emptying position with a filter removed.
Figure 4B:
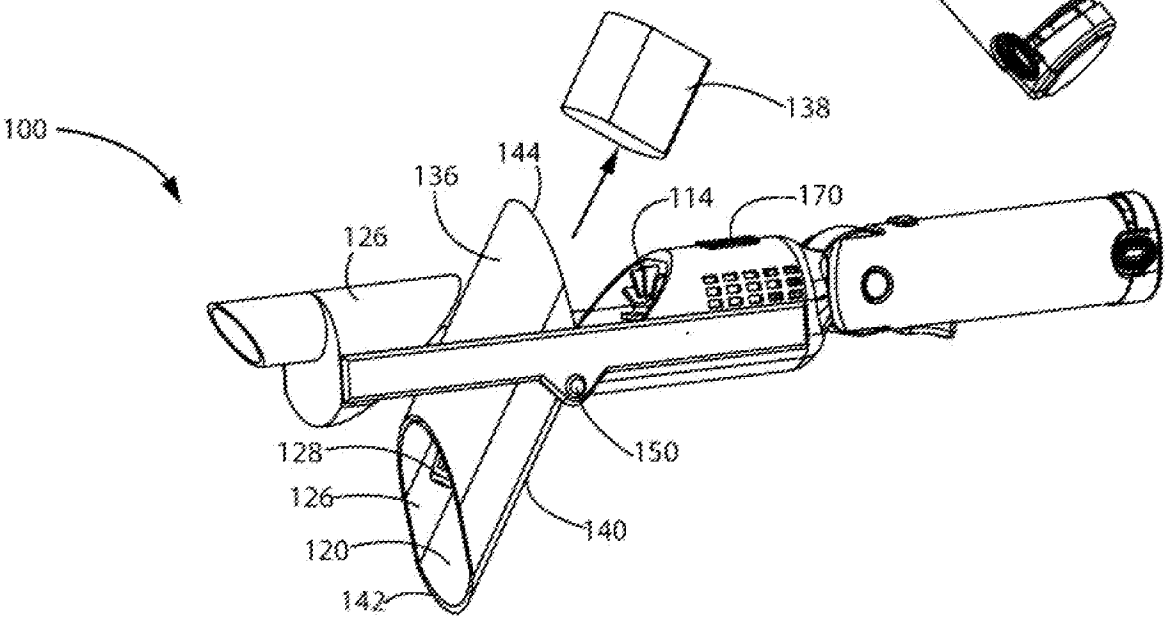

When in the emptying position, as exemplified in FIGS. 3 and 4, each of the air treatment chamber 120 and the filter chamber 130 are open. The first end 142 of the housing provides an open end of the air treatment chamber 120 when the housing 140 is in the emptying position. The second end 144 of the housing 140 provides an open end of the filter chamber 130 when the housing 140 is in the emptying position. In other words, the first end 142 of the housing 140 is open such the portion of the air treatment chamber 120 in the housing 140 may be accessed. The second end 144 of the housing 140 is open such that the portion of the filter chamber 130 in the housing 140 may be accessed.

As described above, during use, and when in the in use position, dust and particulate matter are separated from the air by the screen 128. The dust and particulate matter collect in the air treatment chamber 120, at least a portion of which is provided in housing 140. As such, the housing 140 also collects dust and particulate matter in the portion of the housing 140 defining the air treatment chamber 120. When the housing 140 is moved or rotated to the emptying position, the first end 142 of the housing 140 provides an open end of the air treatment chamber 120. The dust and particulate matter can then be emptied from the housing 140 and the air treatment chamber 120 through the first end 142, e.g., by gravity.

Similarly, the housing 140 includes at least a portion of the filter chamber 130. In some embodiments, the filter 138 may be located in the portion of the filter chamber 130 provided in the housing 140. As exemplified in FIGS. 3 and 4, the filter 138 is located in the portion of the filter chamber 130 provided in the housing 140. When the housing 140 is moved or rotated to the emptying position, the second end 144 of the housing 140 provides an open end of the filter chamber 130. The filter 138 may then be removed from the housing 140 through the second end 144. It will be appreciated that the main body may contain part of the filter chamber and that the filter may remain in position in the part of the filter chamber of the main body when the housing is in the emptying position.

Figure 2A:
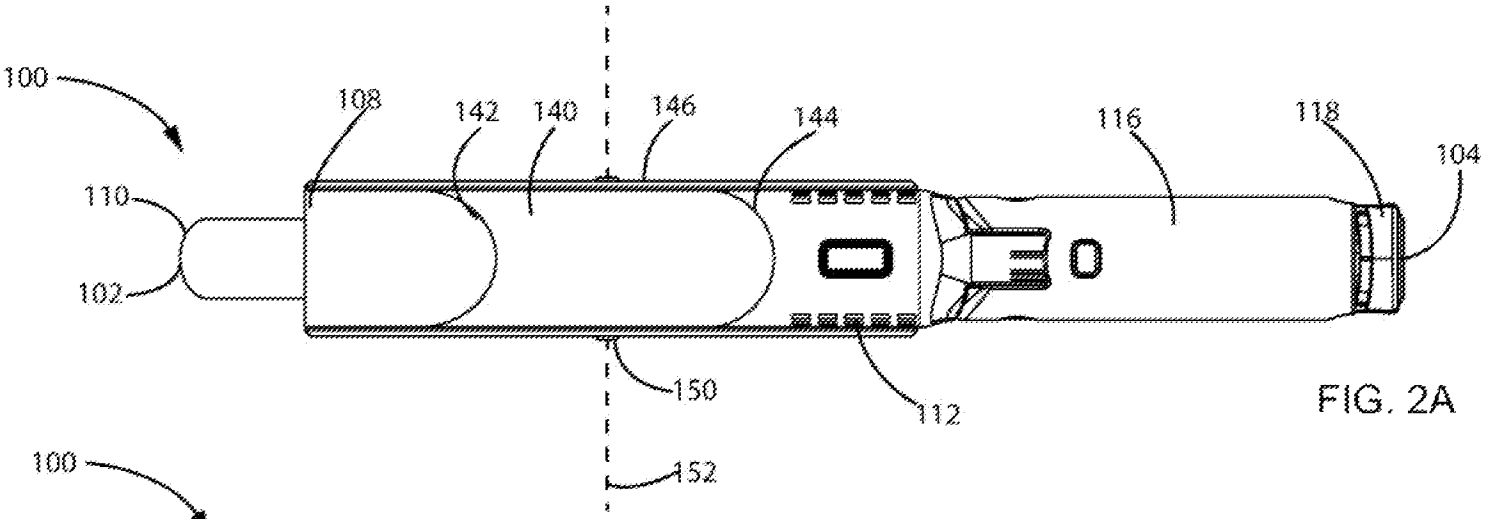
FIGS. 2A to 2C are top, side, and front views respectively of the surface cleaning apparatus of FIG. 1 in the in use position.
Figure 2B:
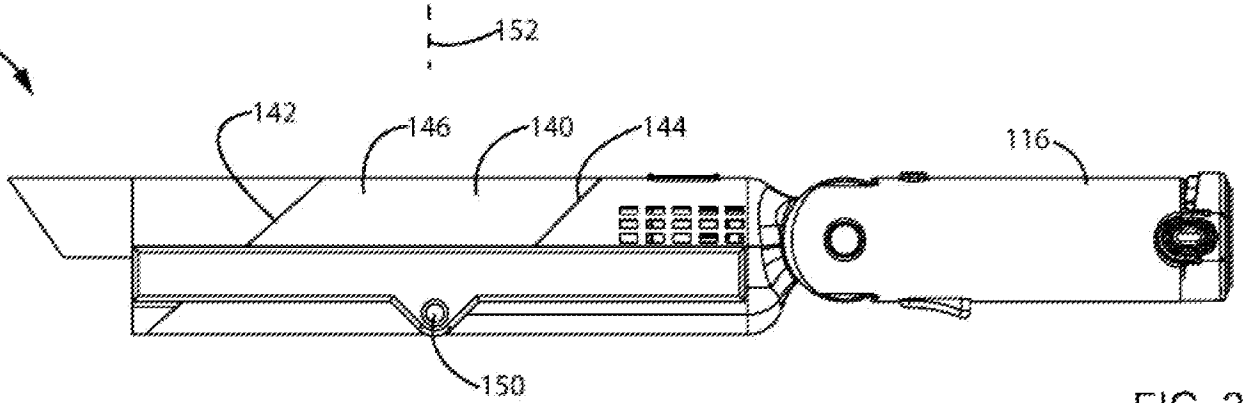
Figure 2C:
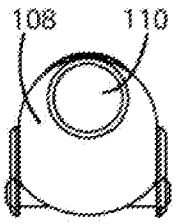

In some embodiments, when in the in use position, the air treatment chamber 120, the filter 138, and the suction motor 114 may be arranged linearly. For example, as shown in FIGS. 1 and 2, the air treatment chamber 120 is positioned in the air flow passage downstream from the dirty air inlet 110, the filter 138 is positioned in the air flow passage downstream from the air treatment chamber 120 and the suction motor 114 is positioned in the air flow passage downstream from the filter 138 such that the air treatment chamber 120, the filter 138 and the suction motor 114 are arranged linearly when the housing 140 is in the in use position.

Figure 5A:
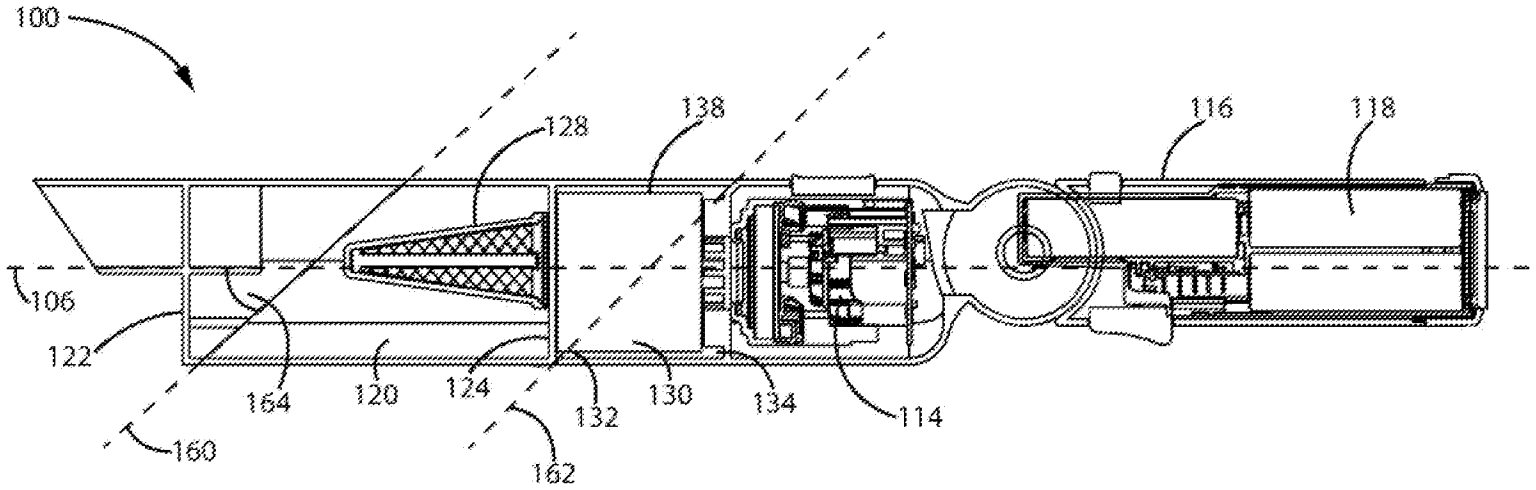
FIG. 5A is a cross-sectional view of the surface cleaning apparatus of FIG. 1 in the in use position.
Figure 5B:
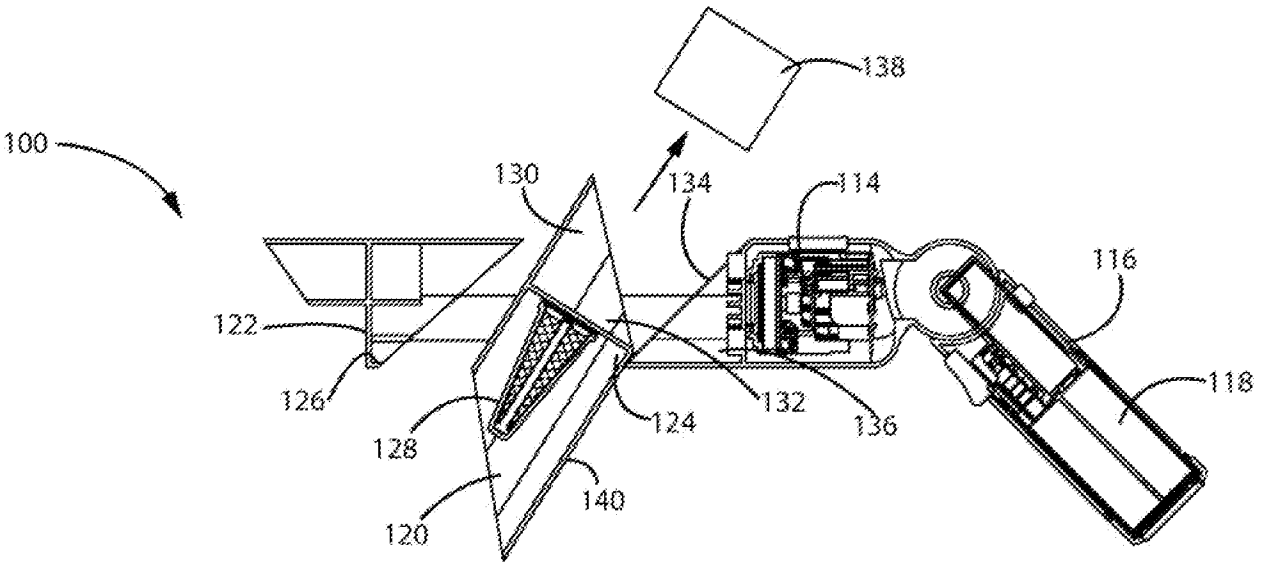
FIG. 5B is a cross-sectional view of the surface cleaning apparatus of FIG. 1 in the emptying position.

The open end of the air treatment chamber defined by housing 140 and the open end of the filter chamber defined by housing 140 may be of various shapes and may mate with abutting surfaces of the main body to define a closed air treatment chamber and a closed filter. As illustrated in FIG. 5A, the open end of the air treatment chamber 120 (first end 142) extends in a first plane 160 and the open end of the filter chamber 130 (second end 144) extends in a second plane 162 that maybe generally parallel to the first plane 160. The longitudinal axis 106 may intersect the first plane 160. An included angle 164 between the longitudinal axis 106 and the first plane 160 may be acute (e.g., 30-60°, optionally about 45°).

As exemplified in FIGS. 3 and 4, when the housing 140 is in the emptying position, the first end 142 may face downwardly and the second end 144 may face upwardly. By having the first end 142 face downwardly, the open end of the air treatment chamber 120 may be used to empty air treatment chamber 120 of dust and particulate matter using gravity. By having the second end 144 face upwardly, the filter 138 does not fall out when the housing 140 is emptied. Additionally, the filter 138 may be easily removed.

As exemplified, pivot axis 152 extends horizontally (when longitudinal axis 106 extends horizontally. Therefore, as exemplified in FIGS. 2, 3, and 4, when moved from the in use position to the emptying position, the first end 142 moves downwardly while the second end moves upwardly. It will be appreciated that, in other embodiments, pivot axis 152 may extend in a different plane. For example, it may extend vertically when the longitudinal axis extends horizontally. In such a case, the first direction may be forwardly while the direction opposite to the first direction may be rearwardly (i.e., as the housing 140 is pivoted open, the open end of the air treatment chamber may rotate rearwardly and the open end of the filter chamber may pivot forwardly.

In some embodiments, a lock releasable by a release mechanism, may be used secure the housing 140 in the in use position. The release mechanism may be located on the housing or on the main body. As exemplified in FIG. 3, the main body 108 includes a housing release mechanism 170. When pressed, the housing release mechanism 170 allows the housing 140 to move from the in use position to the emptying position.

Description of Axially Openable Air Treatment Chamber

In some embodiments, the sidewall 126 of the air treatment chamber 120 may include an upper longitudinally extending portion 125 and a lower longitudinally extending portion 127. The upper and lower longitudinally extending portions 125, 127 may abut at a juncture 129 that extends generally longitudinally. The juncture 129 may be located in a longitudinally extending plane 166. As exemplified in FIGS. 11A to 11D, the longitudinally extending plane 166 may extend generally horizontally when the upper end 101 of the surface cleaning apparatus 100 (which may include the inlet nozzle) is positioned above the lower end 103 of the surface cleaning apparatus. As exemplified in FIGS. 11A to 11D, the longitudinally extending plane 166 may extend generally horizontally. As exemplified in FIGS. 11A to 11D, the longitudinally extending plane 166 may extend from the first end 122 to the second end 124 of the air treatment chamber 120. In some embodiments, the longitudinally extending plane 166 may extend generally horizontally for only a portion of the juncture 129 between the first end 122 and the second end 124. As exemplified in FIGS. 9A to 10D, the longitudinally extending plane 166 extends generally horizontally for a substantial portion of the distance between the second end 124 and the first end 122.

The upper and lower longitudinally extending portions 125, 127 may be moveable between a closed position and an open emptying position. As exemplified, at least a portion of the lower longitudinally extending portion 127 may be pivotally mounted to the main body 108 or another portion of the hand vacuum cleaner. As exemplified in FIGS. 9A to 11D, the lower longitudinally extending portion 127 is pivotally mounted to the main body 108 by a pivot 200, about rotational axis 202.

The lower longitudinally extending portion 127 may rotate downwardly to provide access to the air treatment chamber 120. As exemplified in FIGS. 9A to 10D, a rearward portion of the lower longitudinally extending portion 127 may be pivotally mounted to the main body 108, and as such, the lower longitudinally extending portion 127 may rotate rearwardly.

Alternately, as exemplified in FIGS. 11A to 11D, a forward portion of the lower longitudinally extending portion 127 may be pivotally mounted to the main body 108 by pivot 200, and as such, the lower longitudinally extending portion 127 may rotate downwardly or forwardly.

It will be appreciated that the pivot 200 may be located at the first end 122 of the air treatment chamber 120 (as exemplified by FIGS. 11A to 11D), the second end 124 of the air treatment chamber 120 (as exemplified by FIGS. 9A to 10D), or any location therebetween if, e.g., only part of longitudinal length of the lower portion is moveably mounted. It will also be appreciated that any longitudinally extending portion of the sidewall of the air treatment chamber 120 may be moveable (e.g., the upper portion or a side portion) and therefore the pivot 200 may be located at the upper end 101, the lower end 103 (as exemplified by FIGS. 11A to 11D), or at a location therebetween (as exemplified by FIGS. 10A to 11D).

As described above, during use, and when in the in use position, dust and particulate matter are separated from the air by the air treatment chamber 120. The dust and particulate matter collect in the air treatment chamber 120. When the lower longitudinally extending portion 127 is moved or rotated to the emptying position, the air treatment chamber 120 is opened. The dust and particulate matter can then be emptied from the air treatment chamber 120 through the opening e.g., by gravity. As exemplified in FIGS. 9A to 10D, when the lower longitudinally extending portion 127 is moved to the emptying position, dust and particulate matter may be released from the air treatment chamber 120 by sliding along the lower end 123 and out of the surface cleaning apparatus 100.

In embodiments where the lower longitudinally extending portion 127 includes only a portion of the lower end 123 of the air treatment chamber 120, when the lower longitudinally extending portion 127 is in the emptying position, the surface cleaning apparatus 100 may also be tipped forward or backwards to remove any of the dust and particulate matter that was not removed when the lower longitudinally extending member initially moved to the emptying position.

It will be appreciated that if the air treatment chamber 120 Has a dirt collection chamber external thereto, then both the air treatment chamber 120 and the dirt collection chamber may be concurrently opened.

Description of Forwardly and Rearwardly Openable Housing Portions

In accordance with another aspect, the air treatment chamber may be constructed from two portions, at least one of which is openable, wherein the two parts abut along a juncture that extends at a diagonal to the longitudinal chamber axis. Embodiments of such a design are exemplified in FIGS. 12A to 17D.

As exemplified, the surface cleaning apparatus 100 may have a housing 240. The housing 240 has a first end 242, a second end 244, and a sidewall 245 extending therebetween The housing 240 includes the air treatment chamber 120 such that the first and second ends 242, 244 of the housing 240 may be the same as the first and second ends 122, 124 of the air treatment chamber 120. The housing 240 has a forward portion 248 having a rearward edge 248 and a rearward portion 250 having a forward edge 252. As exemplified in FIGS. 12A to 17D, the forward portion 246 may include the dirty air inlet 110.

Figure 12B:
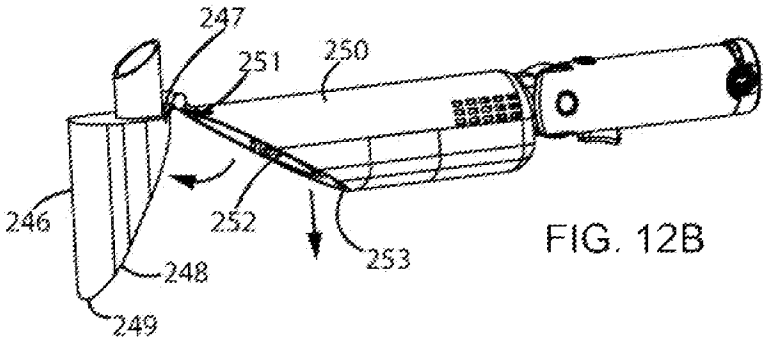
FIG. 12B is a perspective view of the surface cleaning apparatus of FIG. 12A in an emptying position.
Figure 12D:
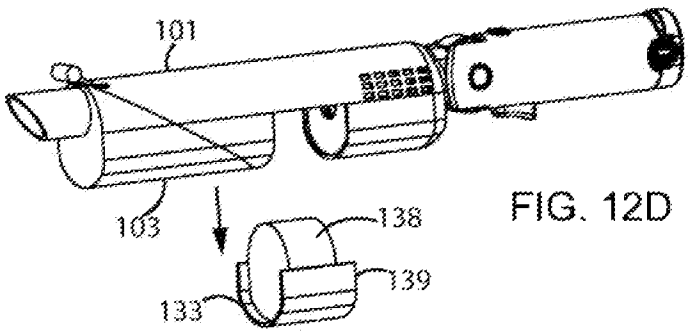
FIG. 12D is a perspective view of the surface cleaning apparatus of FIG. 12A with a filter removed.
Figure 12A:
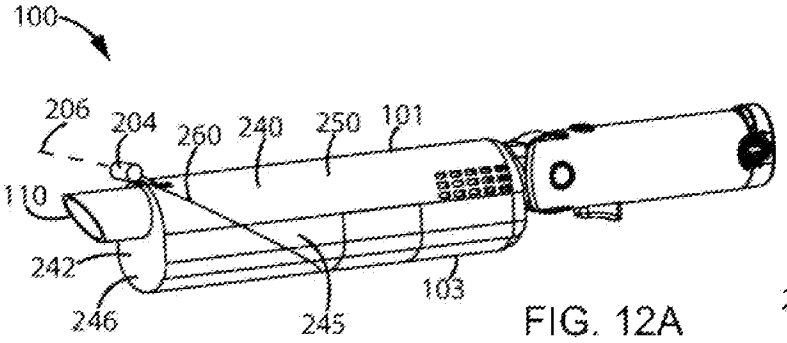
FIG. 12A is a perspective view of a surface cleaning apparatus in an in use position.
Figure 12C:
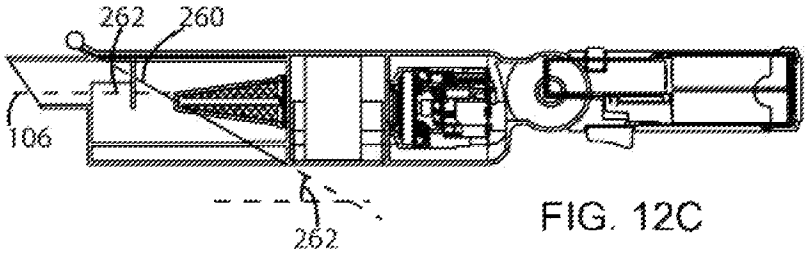
FIG. 12C is a cross-sectional side view of the surface cleaning apparatus of FIG. 12A in the in use position.
Figure 13B:
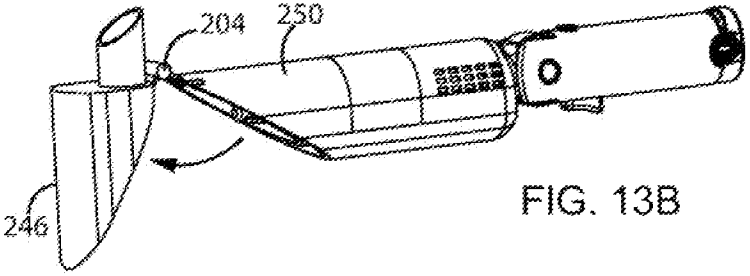
FIG. 13B is a perspective view of the surface cleaning apparatus of FIG. 13A in an emptying position.
Figure 13E:
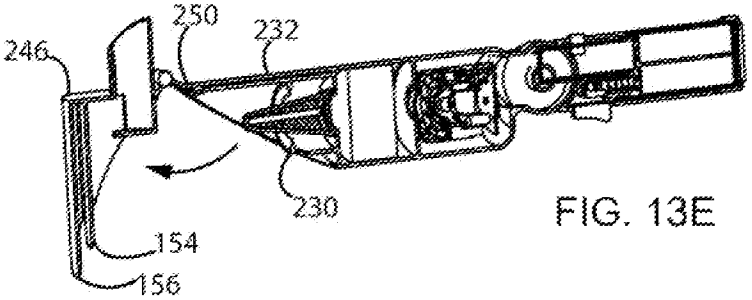
FIG. 13E is a cross-sectional side view of the surface cleaning apparatus of FIG. 13A in the emptying position.
Figure 13A:
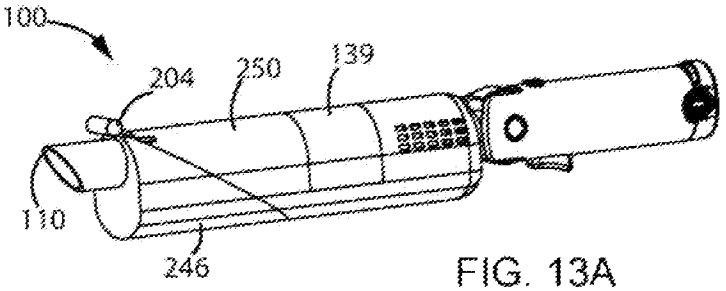
FIG. 13A is a perspective view of a surface cleaning apparatus in an in use position.
Figure 13C:
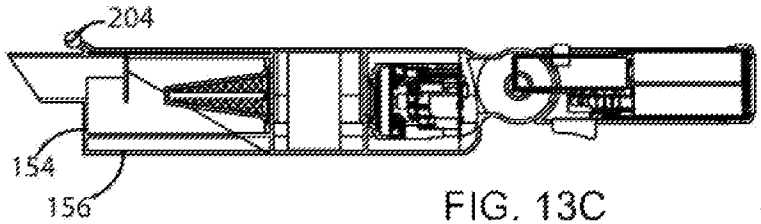
FIG. 13C is a cross-sectional side view of the surface cleaning apparatus of FIG. 13A in the in use position.
Figure 13D:
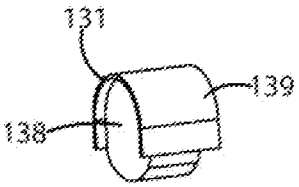
FIG. 13D is a perspective view of the surface cleaning apparatus of FIG. 13A with a filter removed.
Figure 13D:
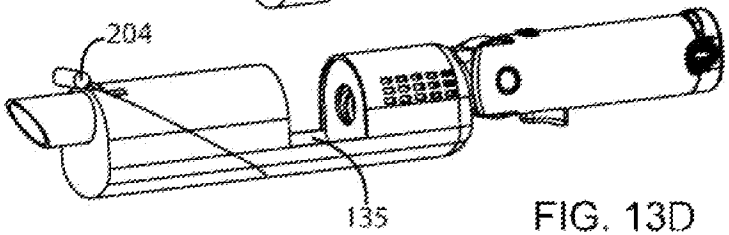
Figure 14B:
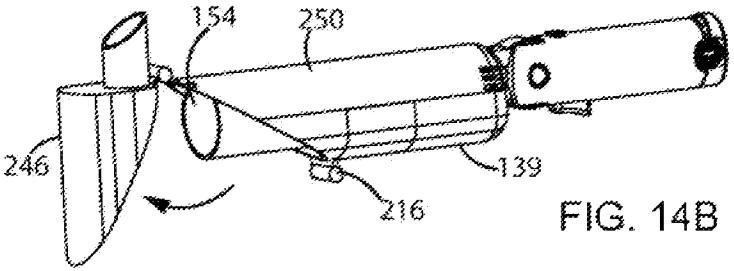
FIG. 14B is a perspective view of the surface cleaning apparatus of FIG. 14A in an emptying position.
Figure 14E:
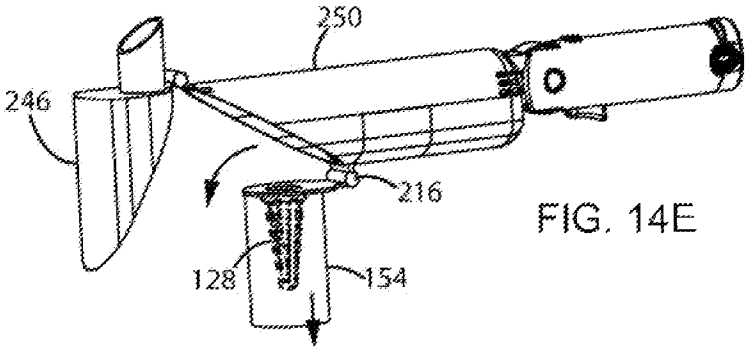
FIG. 14E is a perspective view of the surface cleaning apparatus of FIG. 14A in the emptying position.
Figure 14A:
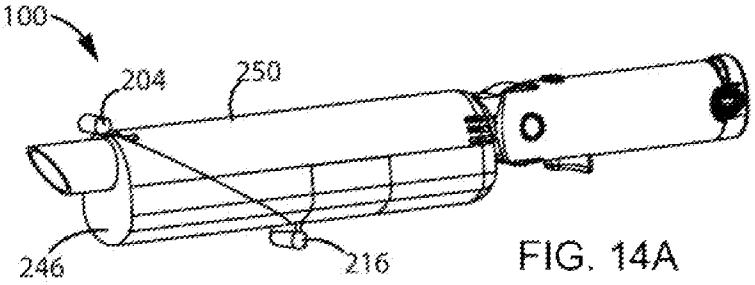
FIG. 14A is a perspective view of a surface cleaning apparatus in an in use position.
Figure 14C:
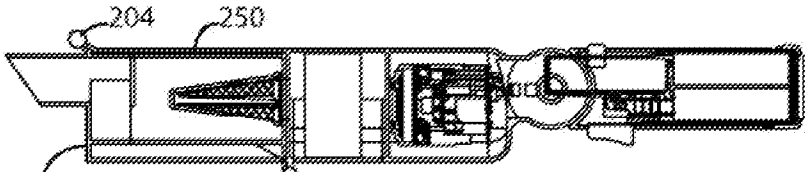
FIG. 14C is a cross-sectional side view of the surface cleaning apparatus of FIG. 14A in the in use position.
Figure 14D:
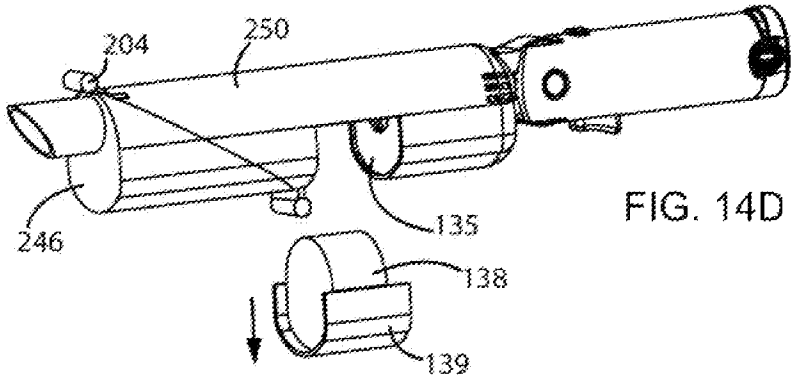
FIG. 14D is a perspective view of the surface cleaning apparatus of FIG. 14A with a filter removed.
Figure 15B:
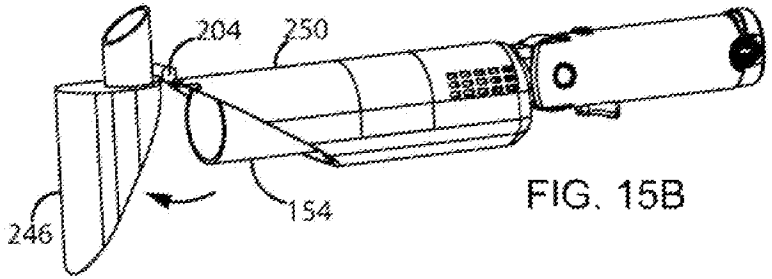
FIG. 15B is a perspective view of the surface cleaning apparatus of FIG. 15A in an emptying position.
Figure 15E:
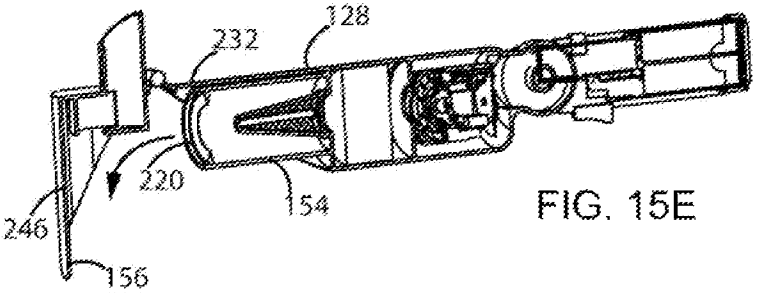
FIG. 15E is a cross-sectional side view of the surface cleaning apparatus of FIG. 15A in the emptying position.
Figure 15A:
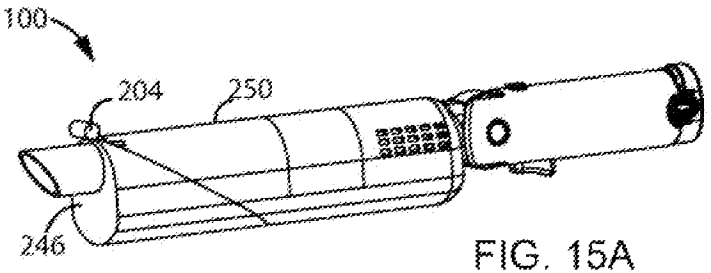
FIG. 15A is a perspective view of a surface cleaning apparatus in an in use position.
Figure 15C:
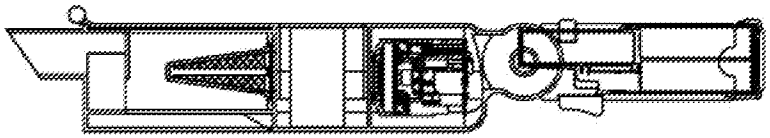
FIG. 15C is a cross-sectional side view of the surface cleaning apparatus of FIG. 15A in the in use position.
Figure 15D:
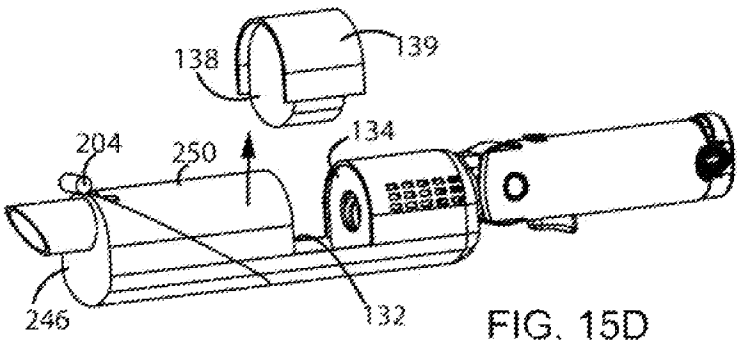
FIG. 15D is a perspective view of the surface cleaning apparatus of FIG. 15A with a filter removed.

In some embodiments, the rearward edge 248 of the forward portion 246 has a front most portion 247 and a rearmost portion 249 and the forward edge 252 of the rearward portion 250 has a front most portion 251 and a rearmost portion 253 (see for example (see FIG. 12B). When in the closed position, the rearmost portion 249 of the rearward edge 248 may be rearward of the front most portion 251 of the forward edge 252 and the front most portion 251 of the forward edge 252 is forward of the rearmost portion 249 of the rearward edge 248.

In some embodiments, the rearmost portion 249 of the rearward edge 248 is below the front most portion 247 of the rearward edge 248 when the longitudinal axis 106 is horizontal and the upper end 101 is above the lower end 103 (see for example (see FIG. 12B).

Figures 16A, 16B, 16C, 16D, 16E:
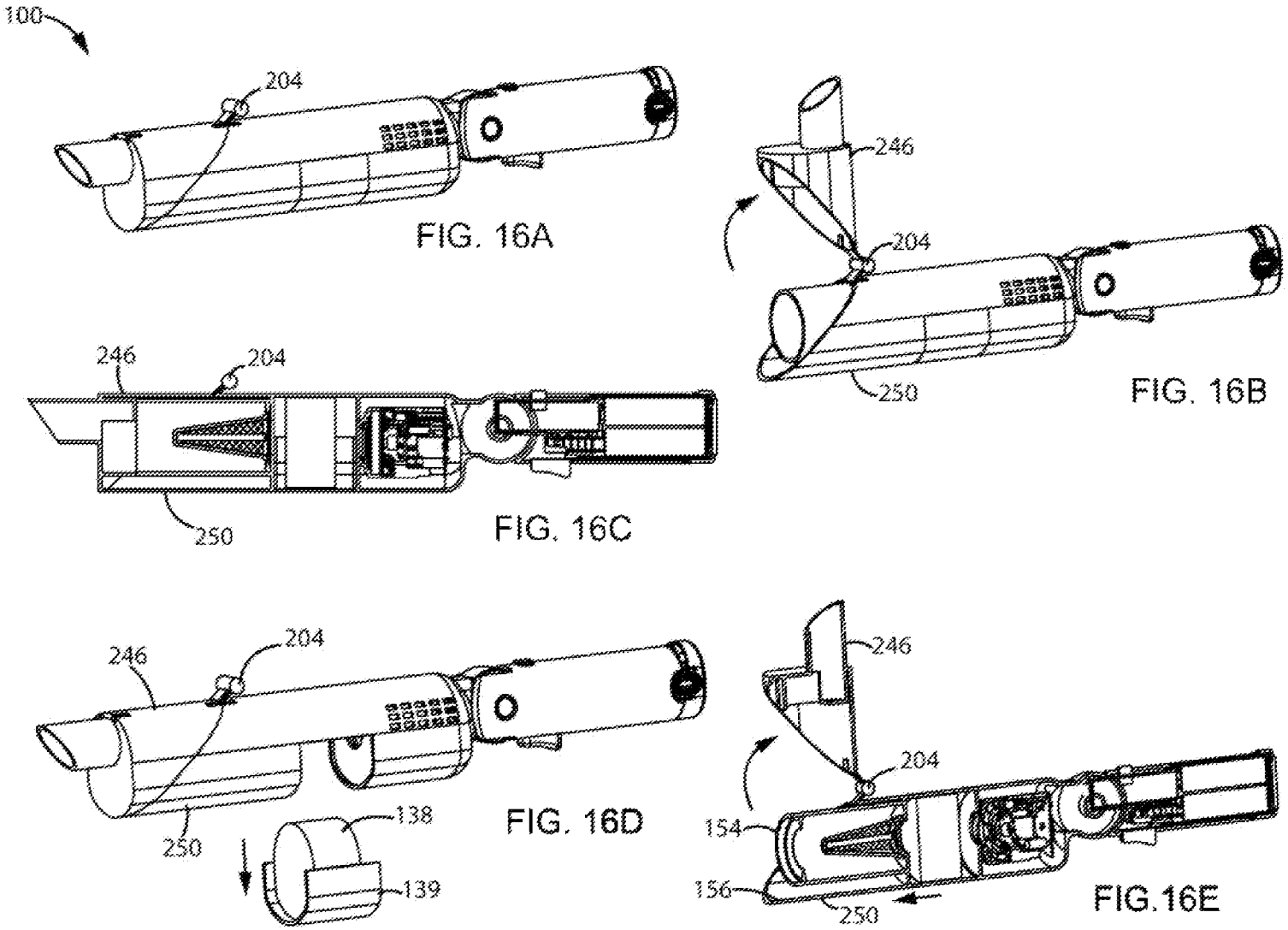
FIG. 16A is a perspective view of a surface cleaning apparatus in an in use position.
FIG. 16B is a perspective view of the surface cleaning apparatus of FIG. 16A in an emptying position.
FIG. 16C is a cross-sectional side view of the surface cleaning apparatus of FIG. 16A in the in use position.
FIG. 16D is a perspective view of the surface cleaning apparatus of FIG. 16A with a filter removed.
FIG. 16E is a cross-sectional side view of the surface cleaning apparatus of FIG. 16A in the emptying position.

In some embodiments, the rearmost portion 249 of the rearward edge 248 is above the front most portion 247 of the rearward edge 248 when the longitudinal axis 106 is horizontal and the upper end 101 is above the lower end 103 (see for example (see FIG. 16B).

The forward edge 252 and the rearward edge 248 may abut at a juncture 260. The juncture 260 may extend at angle 262 to the longitudinal axis. In some embodiments, the angle 262 is between 5 and 85 degrees to the longitudinal axis 106. In some embodiments, the angle 262 may be between 15 and 75 degrees to the longitudinal axis 106. In some embodiments, the angle 262 may be between 30 and 60 degrees to the longitudinal axis 106. As exemplified in FIGS. 12A to 15E, juncture 260 may extend upwardly and forwardly when the longitudinal axis 106 is horizontal and the upper end 101 is above the lower end 103. As exemplified in FIGS. 16A to 17D, the juncture 260 may extend upwardly and rearwardly when the longitudinal axis 106 is horizontal and the upper end 101 is above the lower end 103.

The forward and rearward portions 246, 250 are moveable between a closed position and an open emptying position in which the air treatment chamber 120 is opened. The forward and rearward portions 246, 250 may be rotatably mounted with respect to each other. As exemplified in FIGS. 12A to 15E, the forward portion 246 is pivotally mounted to the front most portion 251 of the rearward portion 250 by a pivot 204, about rotational axis 206. The forward portion 246 may be rotated forwardly from the closed position (as exemplified by FIG. 12A) to the open position (as exemplified by FIG. 12B). As exemplified by FIGS. 16A to 16D, the forward portion 246 may be rotated rearwardly from the closed position to the open emptying position. Accordingly, the rearward portion 250 may be pivotally mounted to the main body 108.

As exemplified in FIG. 17A to 17D, each of the forward and rearward portions 246, 250 may be pivotally coupled to the surface cleaning apparatus 100. As exemplified, the forward portion 246 is rotatably mounted to the upper end 101 of the main body 108 and the rearward portion 250 is rotatably mounted to the lower end 103 of the main body 108. The forward portion 246 is pivotally mounted to the main body 108 by pivot 204 and the rearward portion 250 is pivotally mounted to the main body 108 by pivot 208, about rotational axis 210. The forward portion 246 may rotate upwardly and rearwardly about the axis 206 and the rearward portion 250 may rotate downwardly and rearwardly about the axis 210.

Figure 17B:
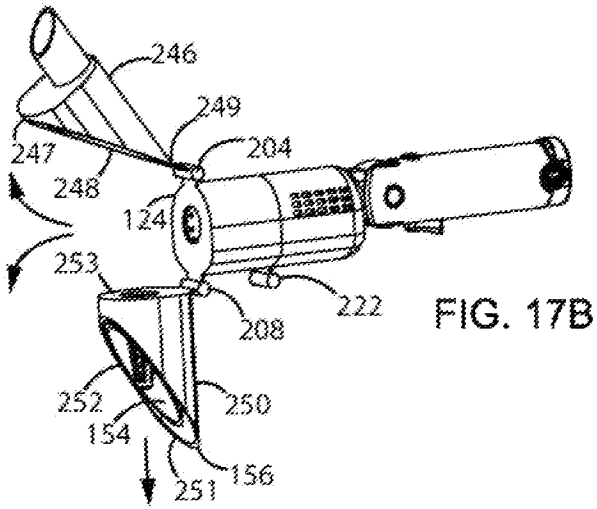
FIG. 17B is a perspective view of the surface cleaning apparatus of FIG. 17A in an emptying position.
Figure 17D:
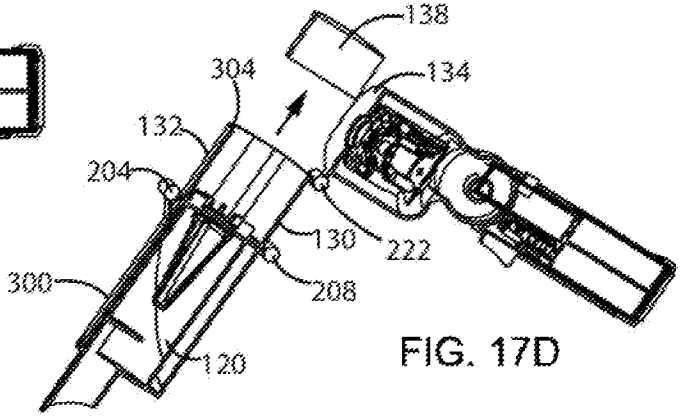
FIG. 17D is a cross-sectional side view of the surface cleaning apparatus of FIG. 17A with a filter removed.
Figure 17A:
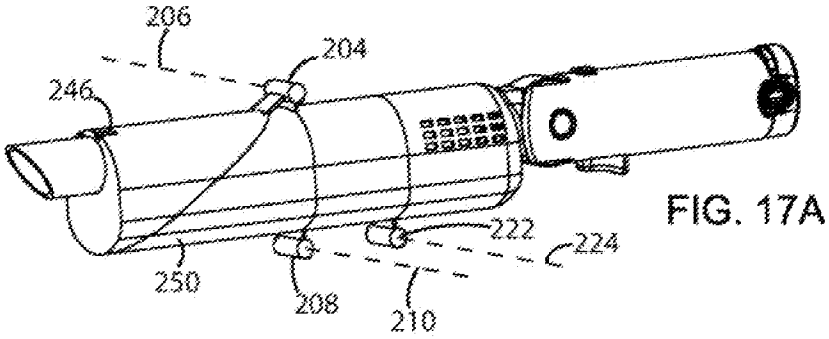
FIG. 17A is a perspective view of a surface cleaning apparatus in an in use position.
Figure 17C:
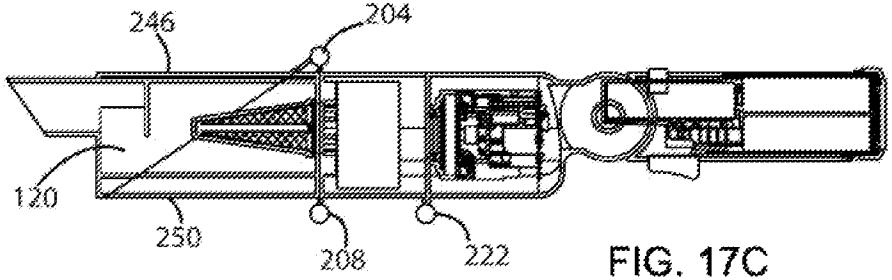
FIG. 17C is a cross-sectional side view of the surface cleaning apparatus of FIG. 17A in the in use position.
Figure 18B:
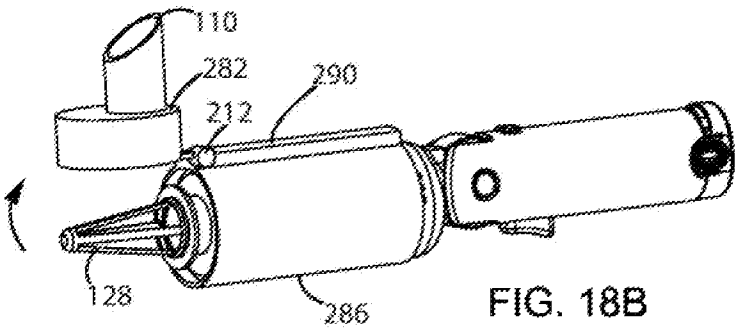
FIG. 18B is a perspective view of the surface cleaning apparatus of FIG. 18A in an emptying position.
Figure 18E:
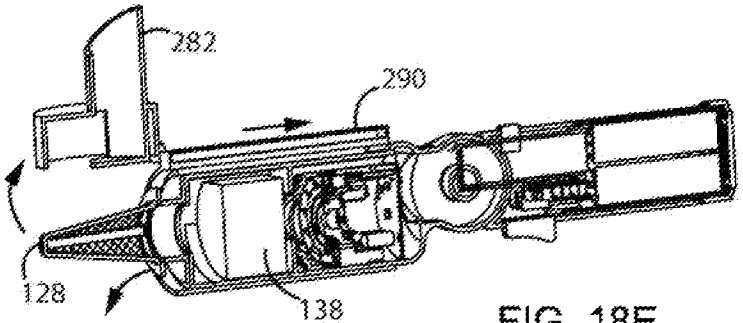
FIG. 18E is a cross-sectional side view of the surface cleaning apparatus of FIG. 18A in the emptying position.
Figure 18A:
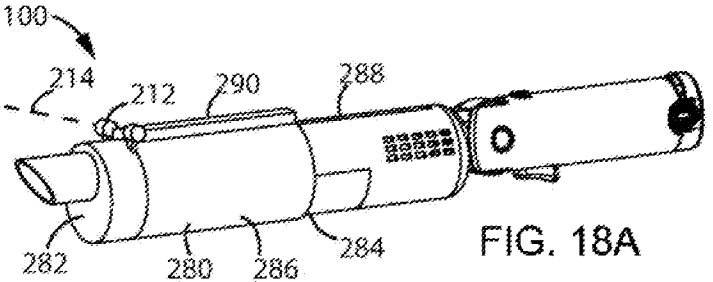
FIG. 18A is a perspective view of a surface cleaning apparatus in an in use position.
Figure 18C:
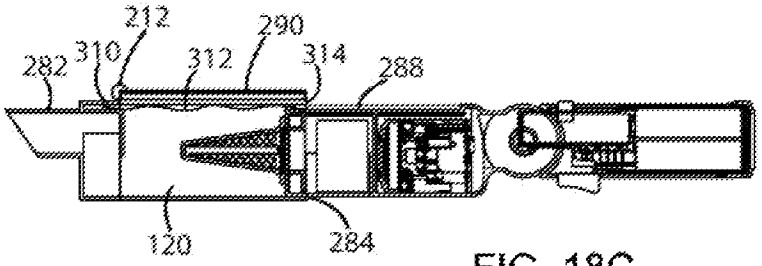
FIG. 18C is a cross-sectional side view of the surface cleaning apparatus of FIG. 18A in the in use position.
Figure 18D:
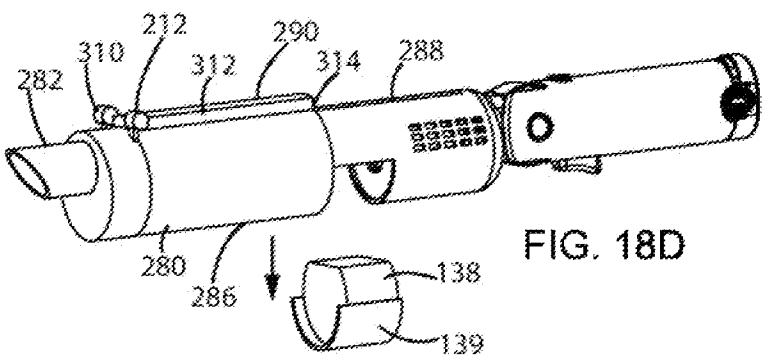
FIG. 18D is a perspective view of the surface cleaning apparatus of FIG. 18A with a filter removed.

As exemplified in FIG. 17B, the air treatment chamber 120 may have a first dirt collecting region 154 (e.g., the interior of the air treatment chamber) and a second dirt collecting region 156 exterior to the first dirt collecting region 154 (e.g., a dirt collection chamber). The first dirt collecting region 154 may collect larger particulate matter, while finer particulate matter may pass through the first dirt collecting region 154 into the second dirt collecting region 156. As exemplified, the first dirt collection region 154 may be a cyclone chamber. When the forward and rearward portions 246, 250 are in the open emptying position, both the first dirt collecting region 154 and the second dirt collecting region 156 may be opened.

As exemplified in FIGS. 9A to 11D, the lower longitudinally extending portion 127 may include both the first dirt collecting region 154 and the second dirt collecting region 156. As exemplified in FIGS. 12A to 13E, the forward portion 246 may include both the first dirt collecting region 154 and the second dirt collecting region 156.

As exemplified in FIGS. 14A to 15E, the forward portion 246 may include only the second dirt collecting region 156. As exemplified in FIGS. 16A to 17D, the forward portion 246 may not include either the first dirt collecting region 154 or a lower end of the second dirt collecting region 156.

It will be appreciated that the forward portion 246 or the lower longitudinally extending portion 127 may include a portion of one or both of dirt collecting regions 154 and 156. Accordingly, when the forward portion 246 or the lower longitudinally extending portion 127 does not include either the first dirt collecting region 154 or the second dirt collecting region 156, or when the forward portion 246 or the lower longitudinally extending portion 127 includes only a portion of the first or second collecting regions 154, 156, the surface cleaning apparatus 100 may be tipped forwards or backwards to ensure that dirt and particulate matter are removed from the air treatment chamber 120.

Description of Rearwardly Translatable Housing

In accordance with another aspect, the sidewall of the air treatment chamber may be moved (translated) rearwardly in order to empty the chamber. The front face of the chamber (or the front face of the hand vacuum cleaner if the front face of the chamber is the front face of the hand vacuum cleaner) may be moved (e.g., rotated) so as to permit the sidewall to be translated rearwardly. An advantage of this design is that the screen 128 may be revealed for cleaning if needed.

In accordance with this aspect, the surface cleaning apparatus 100 may have a housing 280. The housing 280 includes the air treatment chamber 120 and extends from a front end 282 to a rear end 284 with a sidewall 286 extending therebetween. The front end 282 may be located at or near the first end 122 and the rear end 284 may be located at or near the second end 124. The front end 282 may be rotatably mountable to the surface cleaning apparatus 100. The front end 282 may rotate between an in use position and an open emptying position. As exemplified in FIGS. 18A to 18E, the front end 282 may include the dirty air inlet 110.

As exemplified in FIGS. 18A to 18E, the sidewall 286 may be translatable rearwardly subsequently to or as the front end 282 is moved to the open emptying position. As exemplified, the front end 282 may be rotated rearwardly from the closed in use position to the open emptying position. The front end 282 may be coupled to the pivot 212 at a location between the first end 122 and the second end 124 of the air treatment chamber 120.

The main body 108 may include a groove 288 and a flange 290. The flange 290 is slideably coupled to the groove 288. The diameter of the air treatment chamber 120 is larger than the diameter of the filter chamber 130. The pivot 212 may be coupled to the flange 290. To move from the in use position (forward position FIG. 18A) to the emptying position (rearward position FIG. 18B), the front end 282 is rotated upwardly at the pivot 212 (about the rotational axis 214). Once the front end 282 is above the upper end 121 of the air treatment chamber 120, the flange 290 may slide along the groove 288 towards the rear end 104. As exemplified in FIGS. 18B and 18E, the flange 290 may slide along the groove 288 until the screen 128 is fully exposed. In some embodiments, the screen 128 may only be partially exposed.

In some embodiments, the surface cleaning apparatus 100 includes a cleaning tool electrical connector 310. The cleaning tool electrical connector 310 may be electrically engageable with a cleaning tool. For example, the cleaning tool electrical connector 310 may be engageable with the cleaning head 182. In some embodiments, the sidewall 126 may include an electrical lead 312 extending from a main body electrical contact 314 to the cleaning tool electrical connector 310. In some embodiments, the electrical lead 312 may be electrically connected to the main body electrical contact 314 when the sidewall 126 is in its forward position. The electrical lead 312 may be disconnected from the main body electrical contact 314 when the sidewall 126 is in its rearward position.

Description of Cleaning the Screen

In some cases, the screen 128 may become clogged with hair or larger particulate matter or debris. In such cases, it may be desirable to access the screen 128 to clean the hair or debris. According to this aspect, the screen 128 may be positioned in the air treatment chamber 120 during use of the hand vacuum cleaner and may be moveable to a cleaning position subsequent to, or concurrently with the opening of the air treatment chamber. Alternately, or in addition, a cleaning member (e.g., an annular ejector ring) may be translatable along a screen to clean the screen when the air treatment chamber is in the closed or open position.

As exemplified in FIGS. 9A to 10D, the screen 128 may be moveable to the cleaning position when the lower longitudinally extending portion 127 is in the emptying position. As exemplified in FIG. 9A to 10D, the screen 128 may be moveable to the cleaning position concurrently with the lower longitudinally extending portion 127 moving to the open emptying position. As exemplified in FIGS. 10A to 10D, the screen 128 may rotate the same amount as the longitudinally extending portion 127. Alternately, as exemplified in FIGS. 9A to 9D, the screen 128 may rotate to a lesser amount or degree than the lower longitudinally extending portion 127. For example, the screen 128 may rotate, e.g., 45 degrees while the lower longitudinally extending portion 127 may rotate, e.g., 60 degrees. Thus, a larger gap is formed between the screen 128 and the lower longitudinally extending portion 127 in the emptying position. This gap may allow for easier cleaning of the screen 128 by providing additional space for the user to access the screen 128.

In some embodiments, the screen 128 may be moveably mounted to the second end 124 of the air treatment chamber 120. For example, the screen 128 may be pivotally mounted to a pivot 216 and may rotate about a rotational axis 218. As exemplified in FIGS. 11A to 11D, the screen 128 may rotate downwardly. Rotating the screen 128 downwardly may improve the efficiency of the removal of dust and particulate matter from the air treatment chamber 120. Further, larger debris such as hair may more easily be removed from the screen 128 with the assistance of gravity.

As exemplified in FIGS. 11A to 11D, the pivot 216 may be a separate pivot from the pivot 200 for the openable portion of the air treatment chamber.

In some embodiments, some or all of the air treatment chamber 120 may also rotate with the screen 128. As exemplified in FIGS. 14A to 14D, the first dirt collecting region 154 and the screen 128 rotate about the pivot 216. As exemplified in FIGS. 17A to 17D, both the screen 128 and a portion of the air treatment chamber 120 rotate about the pivot 208.

In some embodiments, the screen 128 may be coupled to a biasing member (not shown). When the lower longitudinally extending portion 127 or the forward portion 246 is moved from the in use position to the emptying position, the biasing member may bias the screen 128 downwards for cleaning. When the lower longitudinally extending portion 127 or the forward portion 246 is moved to the emptying position, the screen 128 may be forced to a cleaning position. Alternately, in some embodiments, the biasing member may bias the screen 128 to its in use position.

Whether the screen 128 is moveable or not, as exemplified in FIGS. 13A to 13D, the surface cleaning apparatus 100 may have an ejector 230 translatable forwardly. In some embodiments, the ejector may be translatable forwardly subsequent to the opening of the first dirt collection region 154. The ejector may comprise an annular member or ring 232 moveable between an in use position in which the ejector is positioned at, e.g., the second end 124 of the air treatment chamber 120 and an emptying position in which the ejector has been translated forwardly.

During use, in the in use position, the ejector 230 may remain at the second end 124 of the air treatment chamber 120. The ejector 230 may be coupled to a slider (not shown) that translates between the air treatment chamber 120 and the main body 108 to allow a user to slide the ejector forwardly. As the ejector 230 is moved forwardly it may push dust and particulate matter that has accumulated on or around the screen 128 towards the front of the screen 128, e.g., towards to opening in the air treatment chamber 120 at the first end 122. The ejector 230 may contact the screen 128 to dislodge hair or other particulate matter that may be stuck to the screen 128.

As described above and as exemplified in FIGS. 18A to 18E, the sidewall 286 of the housing 280 may be retractable to provide access to the screen 128. When the sidewall 286 in the rearward position, the screen 128 may be accessed for cleaning using ejector 230.

Description of the Filter Removal

In accordance with another aspect, a pre-motor filter may be provided in a filter chamber that is accessible when the air treatment member is in the closed in use position, e.g., by pivoting one portion of the hand vacuum cleaner relative to another portion, or by translating the pre-motor filter outwardly (e.g., radially outwardly). Alternately, or in addition, the pre-motor filter may be accessible after the air treatment chamber has been opened.

Figure 9B:
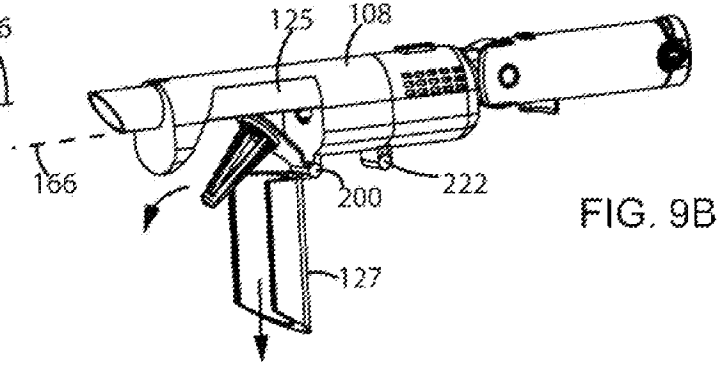
FIG. 9B is a perspective view of the surface cleaning apparatus of FIG. 9A in an emptying position.
Figure 9D:
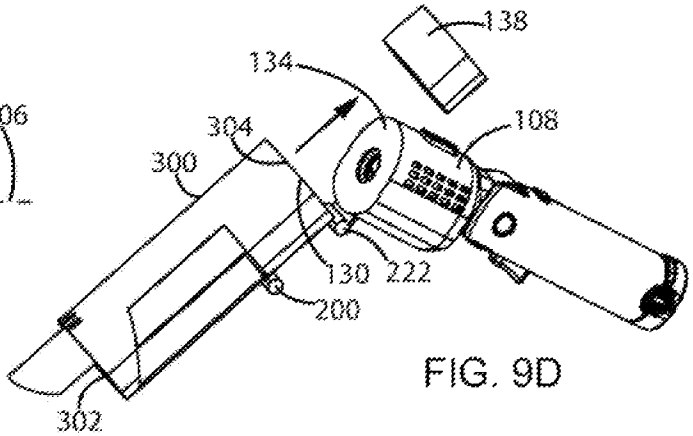
FIG. 9D is a perspective view of the surface cleaning apparatus of FIG. 9A with a filter removed.
Figure 9A:
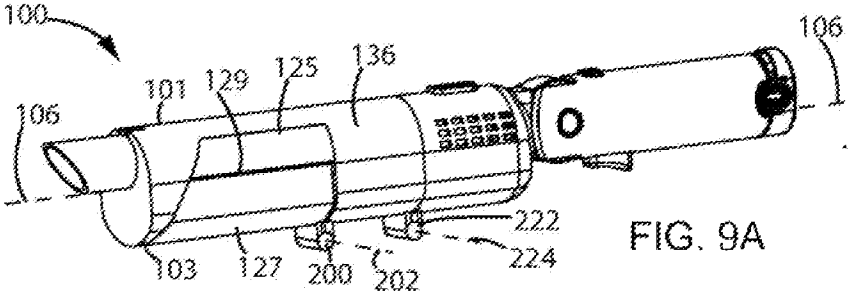
FIG. 9A is a perspective view of a surface cleaning apparatus in an in use position.
Figure 9C:
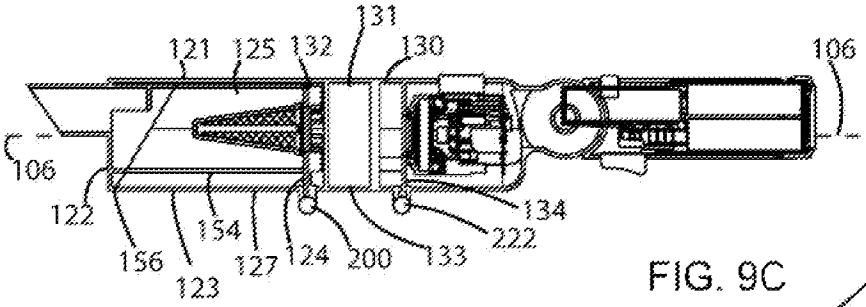
FIG. 9C is a cross-sectional side view of the surface cleaning apparatus of FIG. 9A in the in use position.

According to this aspect, in an embodiment exemplified in FIGS. 9A to 9D, the pre-motor filter chamber may be accessed by rotating one portion of the hand vacuum cleaner relative to another portion. As exemplified, the air treatment chamber 120 may be included in a housing 300 having a front end 302, a rear end 304, and a sidewall extending therebetween. The air treatment chamber 120 may be provided in the housing 300 forward of the pre-motor filter 138. The housing 300 may be rotatably, e.g., pivotally, mounted to the main body 108 and moveable between a closed in use position (FIG. 9C) and an open position (FIG. 9D). The filter chamber 130 may be opened by moving the housing 300 to the open position. As exemplified, the second (rearward) end 134 of the filter chamber 130 may be opened when the housing 300 is rotated to the open position. As exemplified, when the housing 300 is rotated to the open position and the portion of the longitudinal axis 106 extending through the main body 108 extends horizontally, the second end 134 of the filter chamber 130 may be opened and may face upwardly. As exemplified, the housing 300 may be pivotally coupled to a pivot 222 about a rotational axis 224. The pivot 222 may be located at the first end 132 or the second end 134 of the filter chamber 130. As exemplified, the rear end 304 of the housing 300 may be rotatably mounted to the main body 108. As exemplified, the second end 134 of the filter chamber 130 may be rotatably mounted to the main body 108.

As exemplified in FIGS. 9A to 9D, the air treatment chamber 120 may be openable independently of the filter chamber 130. In some embodiments, the air treatment chamber 120 may be openable before or after the filter chamber 130 has been opened.

Figure 10B:
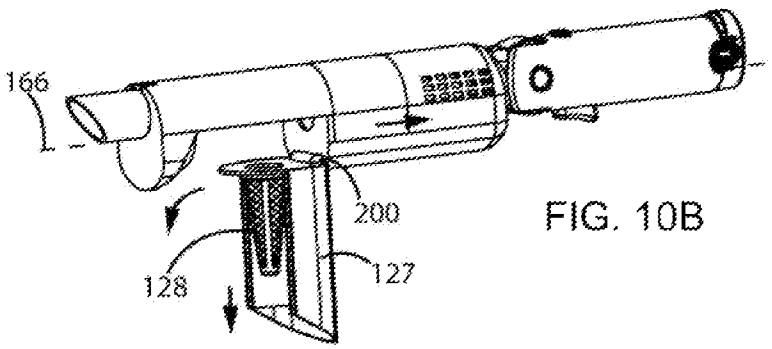
FIG. 10B is a perspective view of the surface cleaning apparatus of FIG. 10A in an emptying position.
Figure 10D:
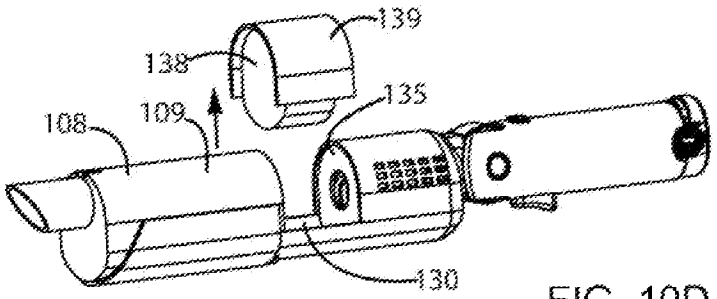
FIG. 10D is a perspective view of the surface cleaning apparatus of FIG. 10A with a filter removed.
Figure 10A:
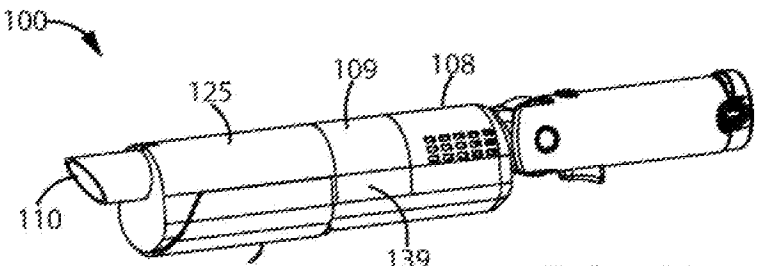
FIG. 10A is a perspective view of a surface cleaning apparatus in an in use position.
Figure 10C:
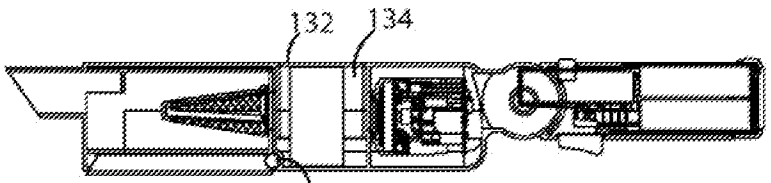
FIG. 10C is a cross-sectional side view of the surface cleaning apparatus of FIG. 10A in the in use position.
Figure 11B:
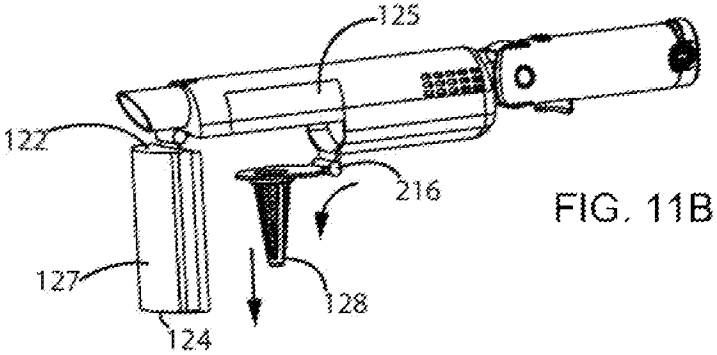
FIG. 11B is a perspective view of the surface cleaning apparatus of FIG. 11A in an emptying position.
Figure 11D:
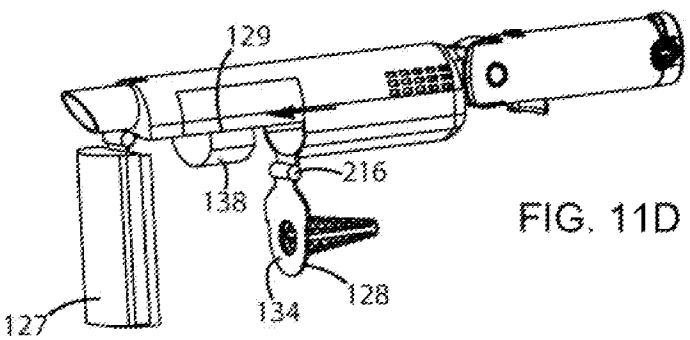
FIG. 11D is a perspective view of the surface cleaning apparatus of FIG. 11A with a filter removed.
Figure 11A:
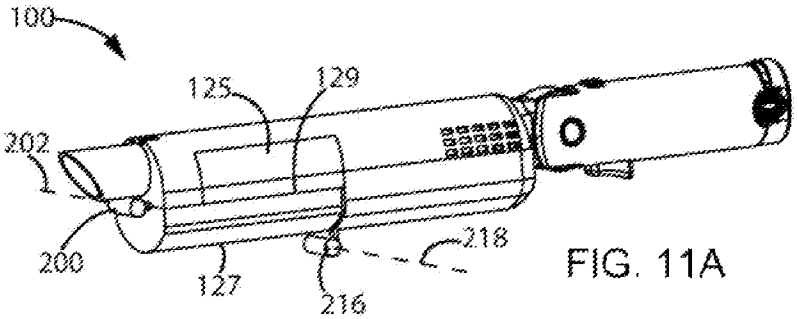
FIG. 11A is a perspective view of a surface cleaning apparatus in an in use position.
Figure 11C:
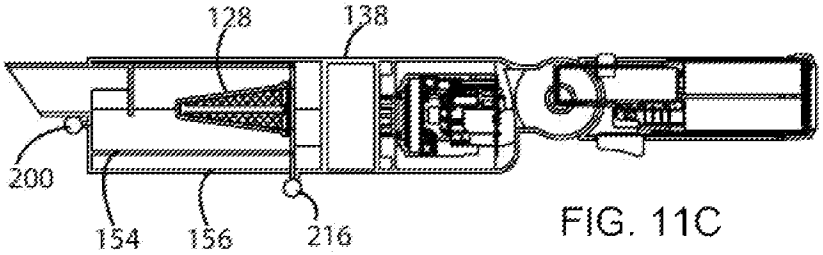
FIG. 11C is a cross-sectional side view of the surface cleaning apparatus of FIG. 11A in the in use position.

As exemplified in FIG. 10D, the filter 138 may be removable when the lower longitudinally extending portion 127 is in the closed position. As exemplified in FIG. 10D, the filter 138 may be removable through an opening 135 in a longitudinally extending sidewall 109 of the main body 108. In some embodiments, a portion of the filter chamber 130 forms a portion of the sidewall 109 of the main body 108. For example, the filter chamber 130 may include a filter cover 139. The filter cover 139 may be removably or moveably coupled to the filter chamber 130 and the sidewall 109 of the main body 108.

When the filter cover 139 is moved or removed from the filter chamber 130, the filter 138 may be accessed. In some embodiments, the filter 138 may be coupled to the filter cover 139 such that when the filter cover 139 is removed from the filter chamber 130, the filter 138 is also removed. By coupling the filter 138 to the filter cover 139, a user may remove the filter 138 without directly contacting the dirty filter 138. A user may then clean the filter 138 by holding onto the filter cover 139. It will be appreciated that, in some embodiments, the filter 138 may not be coupled to the filter cover 139, and the filter 138 may be moved removed separately from the filter cover 139. For example, the filter cover 139 may be rotatably coupled to the main body 108 such that the filter cover 139 may be rotated to provide access to the filter 138.

As exemplified in FIG. 10D, the filter cover 139 may be removed from the upper end 131 of the filter chamber 130. As exemplified in FIG. 12D, the filter cover 139 may be removed from the lower end 133 of the filter chamber 130. It will be appreciated that the filter cover 139 may be removed from the filter chamber 130 sideways or any other direction transverse or generally transverse to the longitudinal axis 106 to provide access to the filter 138.

In some embodiments, the filter 138 may be accessed through the first end 132 of the filter chamber 130 by moving the screen 128. As exemplified in FIGS. 11A to 11D, the filter 138 may be removable through the air treatment chamber 120 when the lower longitudinally extending portion 127 is in the open emptying position. The first end 132 of the filter chamber 130 may be coupled to the screen 128 such that when the screen 128 is moved, the filter chamber 130 is opened to provide access to the filter 138. The filter 138 may then be translated forwardly. As exemplified in FIGS. 11B and 11D, the screen 128 may be rotated about the pivot 216 to provide access to the filter 138 in the filter chamber 130. The filter 138 may then be removed through the air treatment chamber 120 to be cleaned or replaced.

The Handle

Figure 6A:
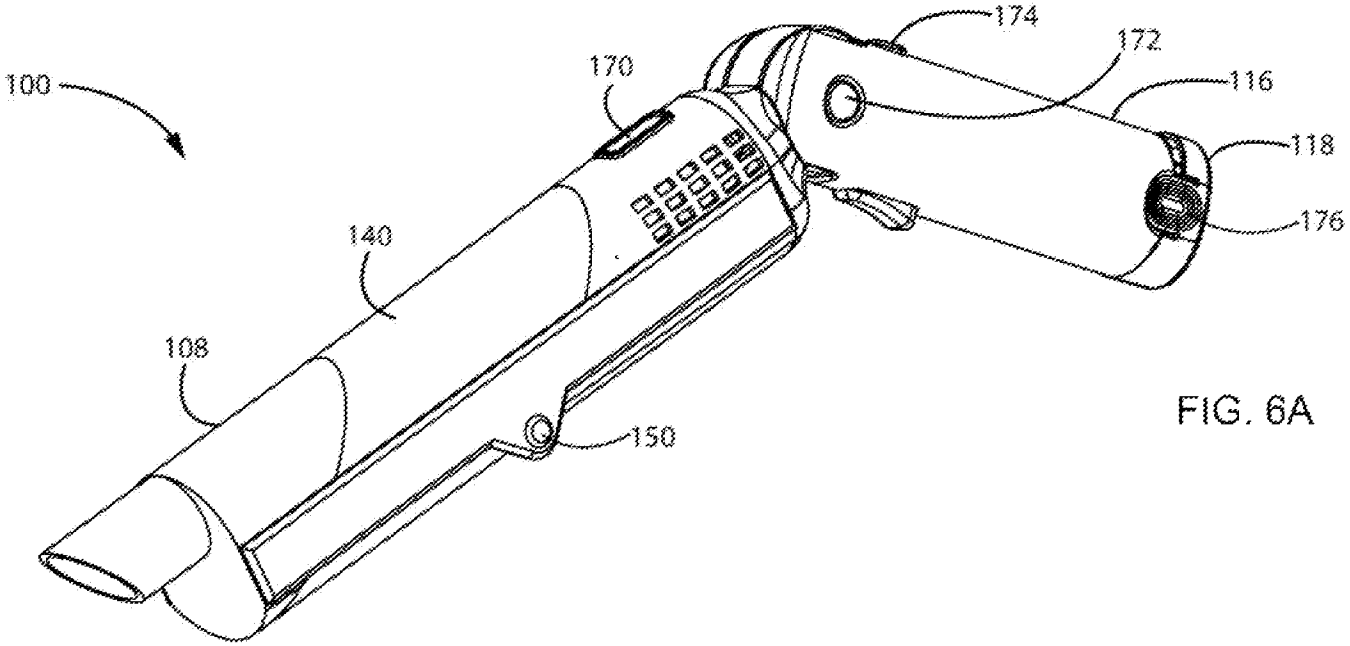
FIGS. 6A and 6B are perspective views of the surface cleaning apparatus of FIG. 1 showing various handle positions.
Figure 6B:
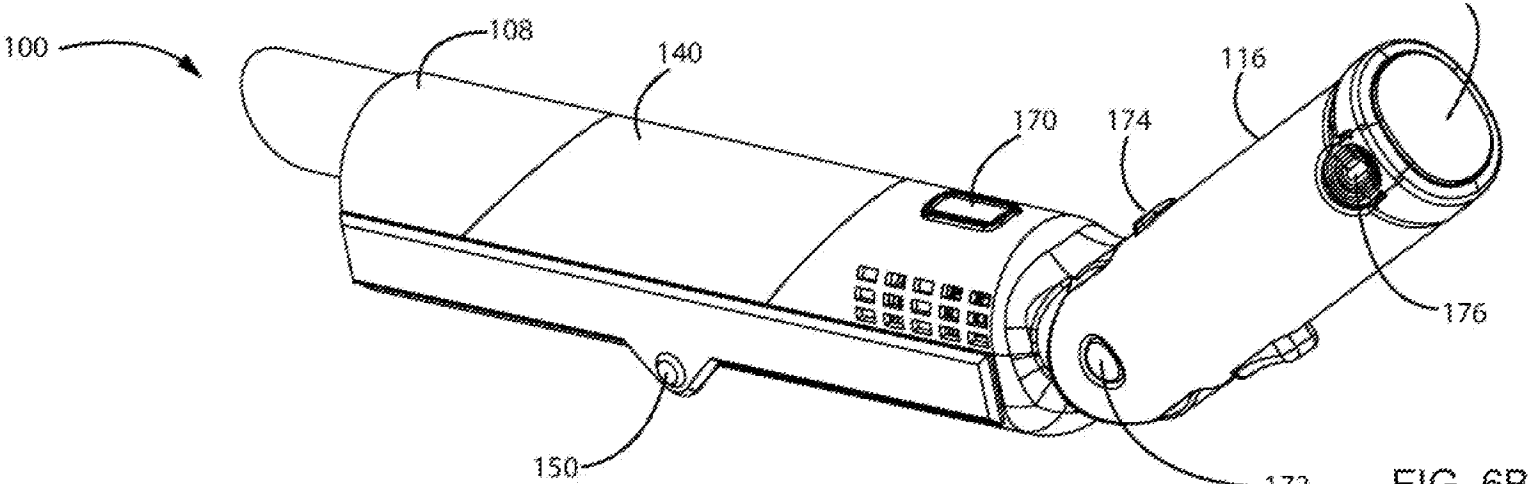

As exemplified in FIGS. 2 and 6, the handle 116 may be rotatably mounted to the rear of the main body. The handle 116 rotates about a hinge 172. In some embodiments, a handle release mechanism may be included to release a lock that secures the handle in a particular position. As exemplified, the handle 116 may include a handle release mechanism 174. When the handle release mechanism 174 is pressed, the handle 116 is free to rotate about the hinge 172. In some embodiments, instead of a handle release mechanism, the hinge 172 may provide resistance to rotation of the handle 116 to prevent accidental rotation of the handle 116. For example, a threshold amount of force may be required to rotate the handle 116 from a first position to a second position. Once the threshold force is reached, the handle 116 may snap to the next position.

Hinge 172 may be a pivot pin. The axis of the pivot pin may extend horizontally when the longitudinal axis 106 is oriented horizontally. Accordingly the handle 116 rotates downwardly to the position exemplified in FIG. 5B.

In some embodiments, the surface cleaning apparatus 100 may include an on board energy storage member, (e.g., a battery or a supercapacitor). The battery or supercapacitor may be charged in situ, in which case the energy storage member, e.g., a battery pack, may be non-moveably mounted to the surface cleaning apparatus, or it may be removable for recharging, such as a removable battery pack.

Figure 7A:
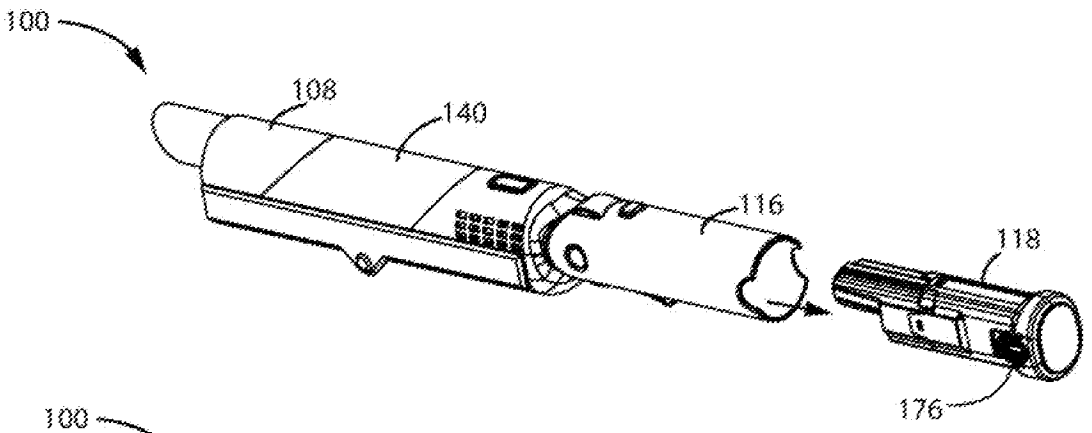
FIGS. 7A and 7B are perspective views of the surface cleaning apparatus of FIG. 1 showing removal of the battery.
Figure 7B:
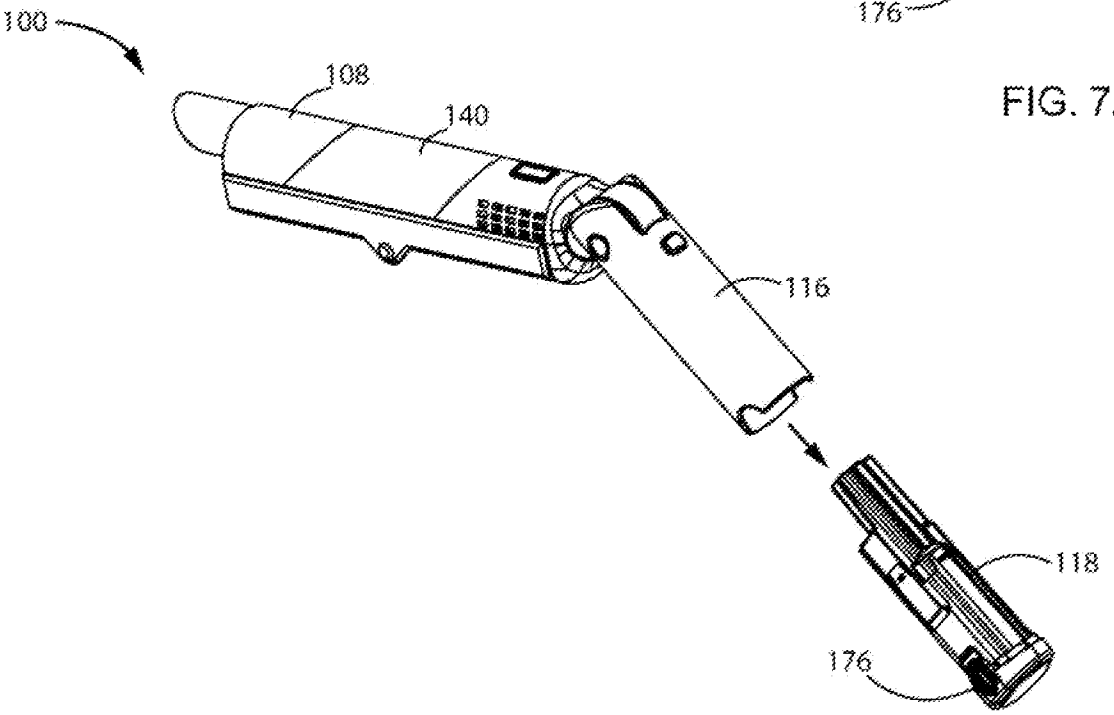

As exemplified in FIGS. 7A and 7B, the surface cleaning apparatus 100 includes a battery pack 118 that is removable, which as exemplified, may be removably receivable via the rear end of the handle. As exemplified, as exemplified, the surface cleaning apparatus 100 may include a battery release mechanism 176. When pressed, the battery release mechanism 176 allows the battery 118 to be removed from the handle 116.

Figures 8A, 8B:
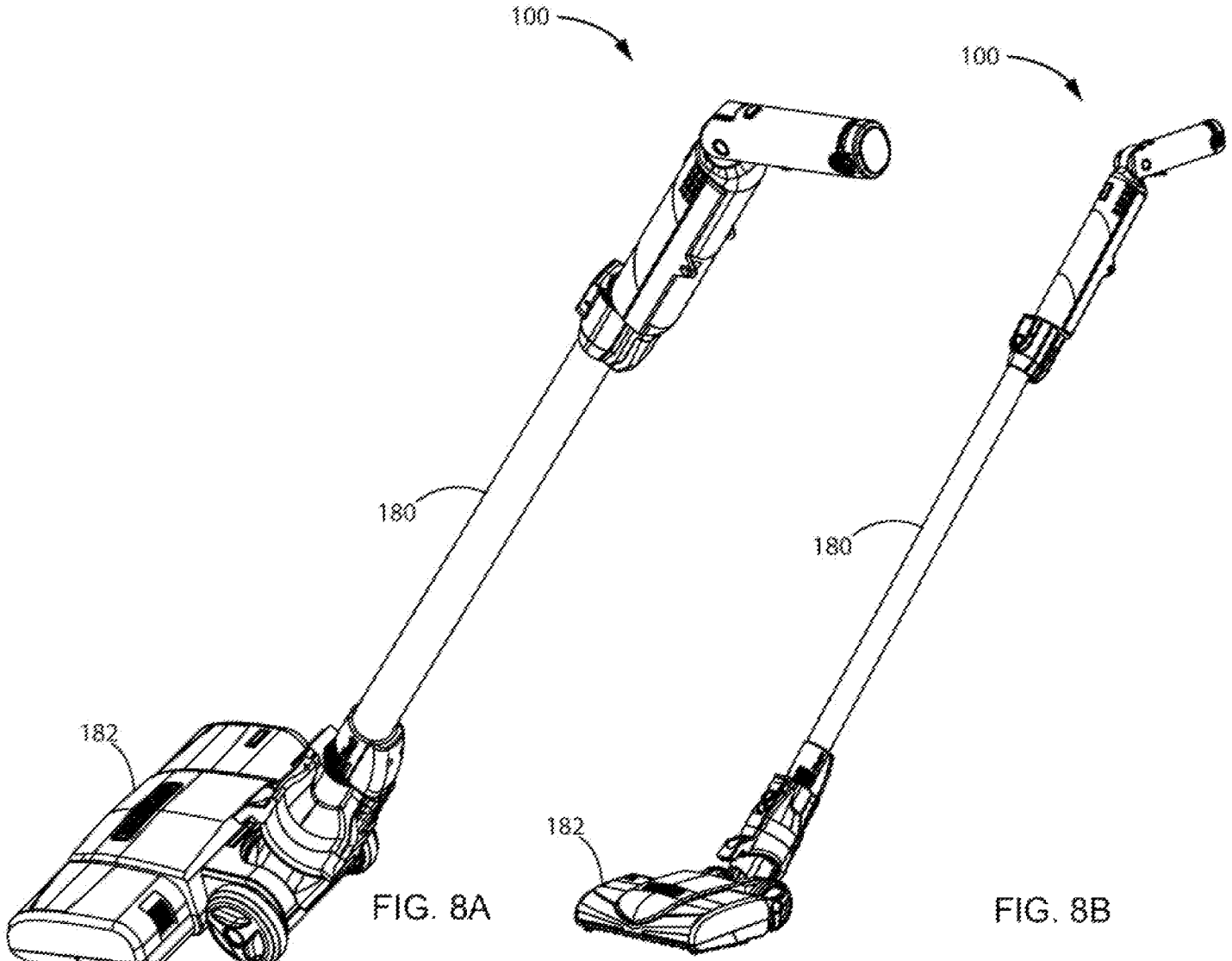
FIGS. 8A and 8B are perspective views of the surface cleaning apparatus of FIG. 1 attached to a wand and a cleaning head.

In some embodiments, as exemplified in FIGS. 8A and 8B, the surface cleaning apparatus 100 may be coupled to an upper end of a wand 180 and the wand 180 may be coupled to a cleaning head 182, so as to define a stick-type vacuum cleaner for floor cleaning use.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A hand vacuum cleaner having a front end having a dirty air inlet, a rear end, an upper end and a lower end, the dirty air inlet is provided at the upper end of the hand vacuum cleaner, the hand vacuum cleaner comprising:

(a) an air treatment chamber having an interior volume, the air treatment chamber comprising a front end, a rear end comprising a rear end wall, an air treatment chamber air inlet to the interior volume, an air treatment chamber air outlet from the interior volume provided at the rear end of the air treatment chamber, and an air treatment chamber axis extending between the front and rear ends of the air treatment chamber, wherein the air treatment chamber air outlet comprises a porous member;

(b) a pre-motor filter positioned downstream of the porous member;

(c) a suction motor positioned downstream of the pre-motor filter, the suction motor having an inlet end that faces forwardly and a suction motor axis of rotation; and, (d) a handle at the rear end of the hand vacuum cleaner, wherein the air treatment chamber axis and the suction motor axis of rotation extend in the same direction, and wherein the air treatment chamber comprises an upper stationary portion and a lower openable portion, the lower openable portion is moveable between a closed position and an open position by a mounting member that is provided adjacent the rear end of the air treatment chamber and at the lower end of the hand vacuum cleaner wherein the lower openable portion is secured to a remainder of the hand vacuum cleaner by the mounting member when the lower openable portion is in the open position, and wherein, when the lower openable portion is in the closed position, each of the lower openable portion and the upper stationary portion define part of the interior volume and, when the lower openable portion is in the open position, the interior volume is open from the front end of the air treatment chamber to the rear end of the air treatment chamber, and wherein the porous member is moveable with the lower openable portion when the lower openable portion is moved to the open position, and wherein the pre-motor filter is provided in a pre-motor filter housing and, when the pre-motor housing is disengaged from a body of the hand vacuum cleaner, the pre-motor filter is removeable in a direction transverse to the air treatment chamber axis.

2. The hand vacuum cleaner of claim 1 wherein the porous member comprises a screen.

3. The hand vacuum cleaner of claim 1 wherein the pre-motor filter has a forward side that faces the air treatment chamber air outlet.

4. The hand vacuum cleaner of claim 1 wherein the lower openable portion has a front end and the front end is angled upwardly and rearwardly from the front end of the air treatment chamber when the lower openable portion is in the closed position.

5. The hand vacuum cleaner of claim 1 wherein the mount is a pivot mount provided at the rear end of the air treatment chamber.

6. The hand vacuum cleaner of claim 1 wherein the mount is provided at the rear end wall of the air treatment chamber.

7. The hand vacuum cleaner of claim 1 wherein the handle comprises an energy storage member housing and the handle extends generally rearwardly.

8. The hand vacuum cleaner of claim 1 wherein the lower openable portion has an open front end.

9. A hand vacuum cleaner having a front end having an inlet passage extending from a dirty air inlet to an inlet port of an air treatment chamber, a rear end, an upper end and a lower end, the dirty air inlet is provided at the upper end of the hand vacuum cleaner, the hand vacuum cleaner comprising:

(a) the air treatment chamber comprising a front end, a rear end, the inlet port, an air treatment chamber air outlet provided at the rear end of the air treatment chamber, a chamber volume and an air treatment chamber axis extending through the chamber volume between the front and rear ends of the air treatment chamber, wherein the air treatment chamber air outlet comprises a porous member, wherein after passing through the inlet port, air directly enters the chamber volume;

(b) a pre-motor filter positioned downstream of the porous member;

(c) a suction motor positioned downstream of the pre-motor filter, the suction motor having an inlet end that faces forwardly and a suction motor axis of rotation; and, (d) a handle at the rear end of the hand vacuum cleaner, wherein the air treatment chamber comprises a stationary portion and a pivotally mounted lower openable portion, each of which define part of the chamber volume, the stationary portion comprises the inlet port, the lower openable portion is moveable between a closed position and an open position about a pivot axis of a pivot mount that is located at a rear end of the lower openable portion, and wherein, when the lower openable portion is in the closed position and the air treatment chamber is closed, a front end of the lower openable portion is angled upwardly and rearwardly from the front end of the air treatment chamber, and wherein the pre-motor filter is provided in a pre-motor filter housing and, when the pre-motor filter housing is disengaged from a body of the hand vacuum cleaner, the pre-motor filter is removeable in a direction transverse to the air treatment chamber axis.

10. The hand vacuum cleaner of claim 9 wherein, when the lower openable portion is in the closed position, a rearward end of the lower openable portion mates with a rear wall along a juncture and the juncture extends generally transverse to the air treatment chamber axis.

11. The hand vacuum cleaner of claim 9 wherein the mount is provided adjacent the air treatment chamber air outlet.

12. The hand vacuum cleaner of claim 9 wherein the porous member is moveable with the lower openable portion when the lower openable portion moves between the closed position and the open position.

13. The hand vacuum cleaner of claim 9 wherein, when the lower openable portion is in the closed position and the air treatment chamber is closed, the front end of the lower openable portion extends at a non-orthogonal angle to the air treatment chamber axis, and the stationary portion has a side that faces the front end of the lower openable portion, that extends at the non-orthogonal angle to the air treatment chamber axis and which abuts the front end of the lower openable portion when the lower openable portion is in the closed position.

14. The hand vacuum cleaner of claim 13 wherein the lower openable portion has an open front end.

15. The hand vacuum cleaner of claim 14 wherein, when the lower openable portion is in the open position, the lower openable portion is open from the from end of the lower openable portion to the rear end of the lower openable portion.

16. The hand vacuum cleaner of claim 9 wherein the porous member is moveable with the lower openable portion when the lower openable portion is moved to the open position and, when the lower openable portion is in the open position, an interior surface of the lower openable portion only partially surrounds the porous member.

17. The hand vacuum cleaner of claim 16 wherein the pre-motor filter is provided in a pre-motor filter housing and, when the pre-motor filter housing is disengaged from a body of the hand vacuum cleaner, the pre-motor filter is removeable in a direction transverse to the air treatment chamber axis.

18. The hand vacuum cleaner of claim 9 wherein the pre-motor filter is provided in a pre-motor filter housing and, when the pre-motor filter housing is disengaged from a body of the hand vacuum cleaner, the pre-motor filter is removeable in a direction transverse to the air treatment chamber axis.

19. The hand vacuum cleaner of claim 9 wherein, when the lower openable portion is in the open position, the chamber volume is open from the front end of the air treatment chamber to the rear end of the air treatment chamber.

20. The hand vacuum cleaner of claim 19 wherein, when the lower openable portion is in the open position, the lower openable portion has an open front end.

* * * * *